US009429887B2

(12) United States Patent
Ohata

(10) Patent No.: US 9,429,887 B2
(45) Date of Patent: Aug. 30, 2016

(54) FIXING DEVICE AND IMAGE FORMING APPARATUS WITH AIR FLOW GENERATOR FOR COOLING AN INTERNAL SPACE OF A SHAFT TO WHICH A MAGNETIC CORE IS MOUNTED

(71) Applicant: KYOCERA Document Solutions Inc., Osaka-shi, Osaka (JP)

(72) Inventor: Shinobu Ohata, Osaka (JP)

(73) Assignee: KYOCERA Document Soultions Inc. (JP)

( * ) Notice: Subject to any disclaimer, the term of this patent is extended or adjusted under 35 U.S.C. 154(b) by 9 days.

(21) Appl. No.: 14/764,263

(22) PCT Filed: Nov. 26, 2014

(86) PCT No.: PCT/JP2014/081235

§ 371 (c)(1),
(2) Date: Jul. 29, 2015

(87) PCT Pub. No.: WO2015/111299

PCT Pub. Date: Jul. 30, 2015

(65) Prior Publication Data

US 2015/0370203 A1 Dec. 24, 2015

(30) Foreign Application Priority Data

Jan. 24, 2014 (JP) ..... 2014-010997

(51) Int. Cl.

| | |
|---|---|
| ***G03G 15/20*** | (2006.01) |
| ***H05B 6/14*** | (2006.01) |
| ***H05B 6/36*** | (2006.01) |
| ***H05B 6/42*** | (2006.01) |

(52) U.S. Cl.

CPC ..... *G03G 15/2053* (2013.01); *G03G 15/20* (2013.01); *H05B 6/145* (2013.01); *H05B 6/365* (2013.01); *H05B 6/42* (2013.01)

(58) Field of Classification Search

CPC ..... G03G 15/2053
USPC ..... 399/329
See application file for complete search history.

(56) References Cited

U.S. PATENT DOCUMENTS

| | | | | |
|---|---|---|---|---|
| 2007/0014599 | A1 | 1/2007 | Yasuda et al. | |
| 2011/0236091 | A1* | 9/2011 | Tanda | G03G 15/2007 399/330 |

FOREIGN PATENT DOCUMENTS

| | | |
|---|---|---|
| JP | 2004-47326 | 2/2004 |
| JP | 2005-234252 | 9/2005 |
| JP | 2009-37264 | 2/2009 |
| JP | 2011-123409 | 6/2011 |
| JP | 2011-227445 | 11/2011 |

OTHER PUBLICATIONS

International Search Report.

* cited by examiner

*Primary Examiner* — Quana M Grainger
(74) *Attorney, Agent, or Firm* — Gerald E. Hespos; Michael J. Porco; Matthew T. Hespos

(57) ABSTRACT

A fixing device includes a housing, a magnetic flux generation source, a first rotary body, a second rotary body, a first core, a second core, a shaft portion, a magnetic shielding body and an air flow generator. The shaft portion has a hollow cylindrical shape, holds the second core on a peripheral surface and includes an internal space extending in an axial direction inside. The shaft portion serves as a rotary shaft in the rotation of the second core. The air flow generator generates an air flow flowing in the internal space of the shaft portion from one end side toward the other end side in the axial direction.

13 Claims, 17 Drawing Sheets

FIXING DEVICE AND IMAGE FORMING APPARATUS WITH AIR FLOW GENERATOR FOR COOLING AN INTERNAL SPACE OF A SHAFT TO WHICH A MAGNETIC CORE IS MOUNTED

TECHNICAL FIELD

The present invention relates to a fixing device for applying a fixing process to a sheet and an image forming apparatus with the same.

BACKGROUND ART

An image forming apparatus such as a copier, a facsimile machine or a printer includes an image forming unit for forming an image on an image carrier (e.g. photoconductive drum), a transfer unit for transferring a toner image on the image carrier onto a sheet as an example of a recording medium and a fixing device for heating and fixing the toner image transferred onto the sheet to the sheet.

There is known a fixing device to which an electromagnetic induction heating (IH) method capable of quick heating and high efficiency heating is applied. In the electromagnetic induction heating method, an induction current is induced in a fixing roller and a fixing belt by a magnetic flux generated by the flow of a high-frequency current in an induction coil and Joule heating (induction heating) is caused in the fixing roller and the fixing belt. A toner image is fixed onto a sheet (recording medium) by this Joule heat.

A technology for suppressing excessive temperature increases of a fixing belt and a fixing roller in a fixing device of an electromagnetic induction heating type is, for example, known from Japanese Examined Patent Publication No. 2011-123409. A fixing device of Japanese Examined Patent Publication No. 2011-123409 includes a fixing belt configured to be induction-heated by a magnetic flux generated by a coil, a pressure roller configured such that a nip portion is formed between the fixing belt and the pressure roller, arch cores and side cores configured to form a magnetic path together with the fixing belt, a center core arranged between the arch cores and the fixing belt when viewed from the magnetic path and a magnetic shielding plate attached to the outer surface of the center core. The magnetic shielding plate comes to be located in the magnetic path with the rotation of the center core and suppresses excessive temperature increases of the fixing belt and the fixing roller in sheet non-passage areas by shielding or suppressing the magnetic flux in accordance with the sheet non-passage areas. Further, a technology for cooling an electromagnetic induction heating unit of a fixing device by cooling air is disclosed in Japanese Examined Patent Publication No. 2011-227445.

SUMMARY OF INVENTION

In the fixing device described in Japanese Examined Patent Publication No. 2011-123409, only parts of a peripheral surface of the center core are exposed on the upper surface of the electromagnetic induction heating unit through air gaps of the coil. Thus, there has been a problem that the center core cannot be sufficiently cooled when the coil is cooled by cooling air.

The present invention aims to efficiently cool a rotating core in a fixing device of an electromagnetic induction heating type and an image forming apparatus with the same.

A fixing device according to one aspect of the present invention includes a housing, a magnetic flux generation source, a first rotary body, a second rotary body, a first core, a second core, a shaft portion, a magnetic shielding body and an air flow generator. The magnetic flux generation source is fixed to the housing and generates a magnetic flux. The first rotary body is rotated in a predetermined direction and induction-heated by the magnetic flux. The second rotary body is rotated in a predetermined direction, and a nip portion through which a sheet carrying a toner image passes is formed between the first and second rotary bodies. The first core is made of a magnetic material and forms a magnetic path, along which the magnetic flux passes, together with the first rotary body. The second core is made of a magnetic material, arranged between the first core and the first rotary body when viewed from the magnetic path and rotatable in a predetermined direction. The shaft portion has a hollow cylindrical shape, holds the second core on a peripheral surface, includes an internal space extending along an axial direction inside and serves as a rotary shaft in the rotation of the second core. The magnetic shielding body is made of a nonmagnetic material and arranged on a peripheral surface of the second core or the shaft portion and shields or suppresses the magnetic flux by being located in the magnetic path with rotation about the shaft portion. The air flow generator generates an air flow flowing in the internal space from one end side toward the other end side in the axial direction. The magnetic flux generation source is fixed to the housing to surround the second core extending in the axial direction when viewed in a direction perpendicular to the axial direction.

An image forming apparatus according to another aspect of the present invention includes an image carrier, a transfer unit and the above fixing device. A toner image is formed on a surface of the image carrier. The transfer unit transfers the toner image onto a sheet.

According to the present invention, it is possible to efficiently cool a rotating core in a fixing device of an electromagnetic induction heating type and an image forming apparatus provided with the same.

An object, features and advantages of the present invention will become more apparent upon reading the following detailed description along with the accompanying drawings.

DESCRIPTION OF EMBODIMENTS

Figure 1:
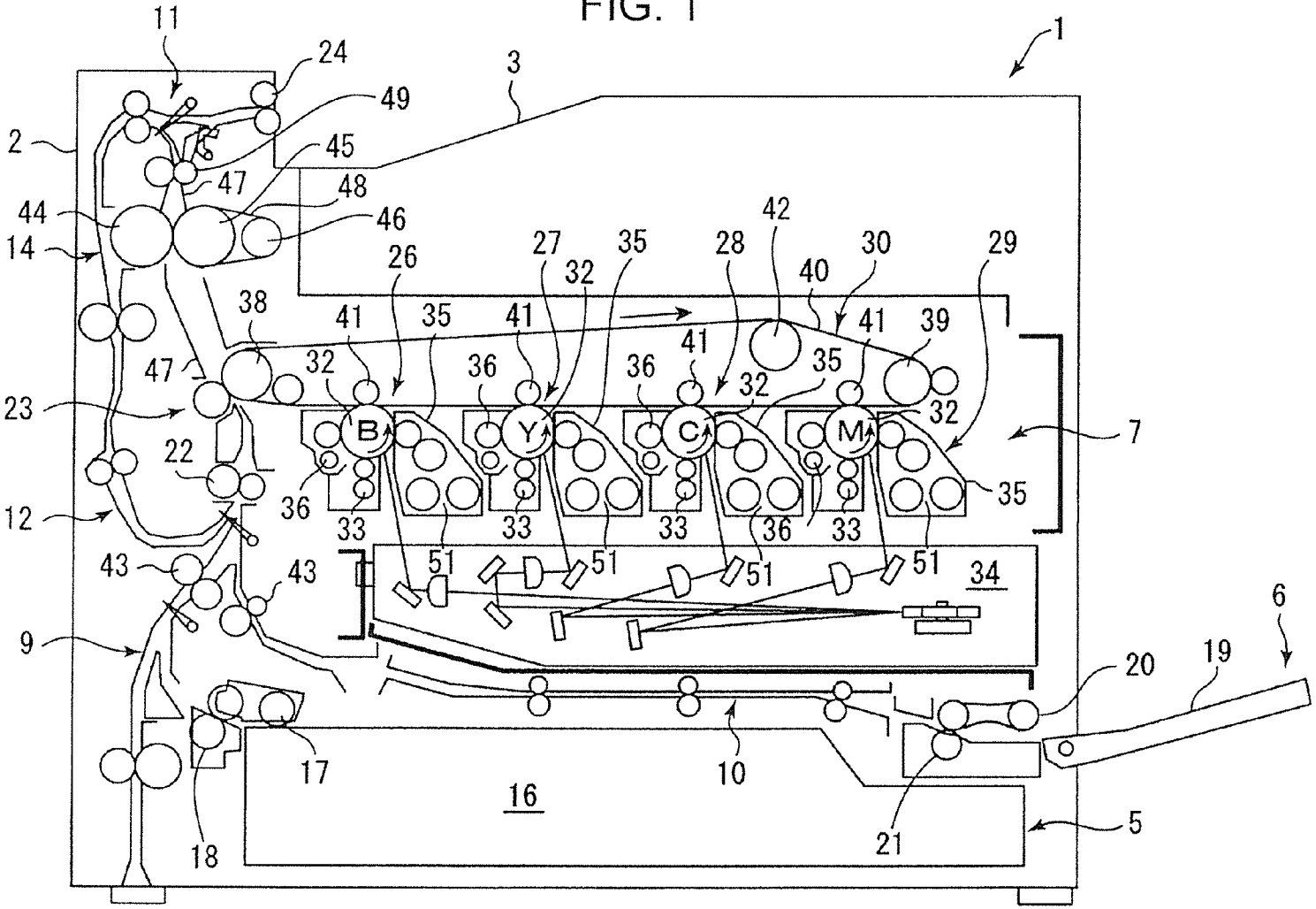
FIG. 1 is a sectional view showing the internal structure of an image forming apparatus according to one embodiment of the present invention.

Hereinafter, embodiments of the present invention are described in detail using the drawings. FIG. 1 is a sectional view showing the internal structure of an image forming apparatus 1 according to one embodiment of the present invention. The image forming apparatus 1 can be a printer, a copier, a facsimile machine, a complex machine having a combination of those functions, or the like for transferring and printing a toner image on a surface of a sheet as an example of a recording medium, for example, based on externally input image information.

The image forming apparatus 1 shown in FIG. 1 is, for example, a tandem-type color printer. The image forming apparatus 1 includes an apparatus main body 2 in the form of a rectangular box for forming a color image on a sheet inside, and a discharge tray 3 to which a sheet printed with a color image is discharged is provided on an upper surface part of the apparatus main body 2. In the apparatus main body 2, a sheet cassette 5 for storing sheets is arranged in a lower part. Further, a stack tray 6 on which a manually fed sheet is placed is arranged on a right side surface of the apparatus main body 2 in FIG. 1. An image forming station 7 is provided in an upper part of the apparatus main body 2 and forms an image on a sheet based on image data such as characters and pictures transmitted from the outside of the apparatus.

A first conveyance path 9 for conveying a sheet fed from the sheet cassette 5 to the image forming station 7 is arranged at a position to the left of the image forming station 7 in FIG. 1. A second conveyance path 10 for guiding a sheet placed on the stack tray 6 to the first conveyance path is arranged at a position above the sheet cassette 5. A pair of conveyor rollers 43 for conveying the sheet are arranged in each of the first and second conveyance paths 9 and 10. Further, a fixing device 14 for applying a fixing process to a sheet having an image formed thereon in the image forming station 7 and a third conveyance path 11 for conveying the sheet, to which the fixing process was applied, to the discharge tray 3 are arranged in a left-upper part of the apparatus main body 2.

The sheet cassette 5 is detachably mountable into the apparatus main body 2 and includes a storage 16. At least two types of sheets having different sizes in a sheet feeding direction can be selectively stored in the storage 16. The sheets stored in the storage 16 are fed to the first conveyance path 9 one by one by a feed roller 17 and a pair of separation rollers 18.

The stack tray 6 is openable and closable relative to the apparatus main body 2 and sheets are placed on a manual feed surface 19 thereof. The sheets placed on the manual feed surface 19 are fed one by one by a pickup roller 20 and a pair of separation rollers 21.

The first and second conveyance paths 9, 10 join at a position before a pair of registration rollers 22. A sheet brought to the pair of registration rollers 22 temporarily waits here and is fed toward a secondary transfer unit 23 after a skew adjustment and a timing adjustment are performed. A full-color toner image on an intermediate transfer belt 40 is secondarily transferred to the fed sheet at the secondary transfer unit 23. Thereafter, the sheet having the toner image fixed in the fixing device 14 is reversed in a fourth conveyance path 12 if necessary and a full-color toner image is secondarily transferred also to an opposite surface in the secondary transfer unit 23. After the toner image on the opposite surface is fixed in the fixing device 14, the sheet is discharged to the discharge tray 3 by a pair of discharge rollers 24 through the third conveyance path 11.

The image forming station 7 includes four image forming units 26 to 29 for forming each of toner images of black (B), yellow (Y), cyan (C) and magenta (M) and an intermediate transfer unit 30 for combining and carrying toner images of the respective colors formed in the image forming units 26 to 29.

Each image forming unit 26 to 29 includes a photoconductive drum 32 (image carrier), a charger 33 arranged to face a circumferential surface of the photoconductive drum 32, a laser scanning unit 34 arranged downstream of the charger 33 in a rotating direction of the photoconductive drum 32 and configured to irradiate a laser beam to a specific position on the circumferential surface of the photoconductive drum 32, a developing device 35 arranged downstream of a laser irradiation position from the laser scanning unit 34 in the rotating direction of the photoconductive drum 32 and arranged to face the circumferential surface of the photoconductive drum 32 and a cleaner 36 arranged downstream of the developing device 35 in the rotating direction of the photoconductive drum 32 and arranged to face the circumferential surface of the photoconductive drum 32.

The photoconductive drum 32 of each image forming unit 26 to 29 is rotated in a counterclockwise direction in FIG. 1 by an unillustrated drive motor. The developing device 35 of each image forming unit 26 to 29 includes a developer container 51 storing two-component developer including black toner, yellow toner, cyan toner or magenta toner.

The intermediate transfer unit 30 includes a drive roller 38 arranged at a position near the image forming unit 26, a driven roller 39 arranged at a position near the image forming unit 29, a tension roller 42 arranged at a position between the drive roller 38 and the driven roller 39, the intermediate transfer belt 40 mounted on the drive roller 38, the driven roller 39 and the tension roller 42 and four transfer rollers 41 arranged to be pressable into contact with the photoconductive drums 32 of the respective image forming units 26 to 29 via the intermediate transfer belt 40.

In the intermediate transfer unit 30, a full-color toner image is formed by transferring toner images of the respective colors in a superimposed state onto the intermediate transfer belt 40 from the photoconductive drums 32 at the positions of the transfer rollers 41 of the respective image forming units 26 to 29.

Conveyance paths 47 are provided upstream and downstream of the fixing device 14 in a sheet conveying direction. A sheet conveyed through the secondary transfer unit 23 is guided to the fixing device 14 through the upstream conveyance path 47. The sheet, to which the fixing process was applied, is guided to the third conveyance path 11 through the downstream conveyance path 47.

The third conveyance path 11 guides the sheet, to which the fixing process was applied in the fixing device 14, to the discharge tray 3. A pair of conveyor rollers 49 for conveying the sheet to the discharge tray 3 are arranged in the third conveyance path 11 and the pair of discharge rollers 24 are arranged at the exit of the third conveyance path 11.

Figure 2:
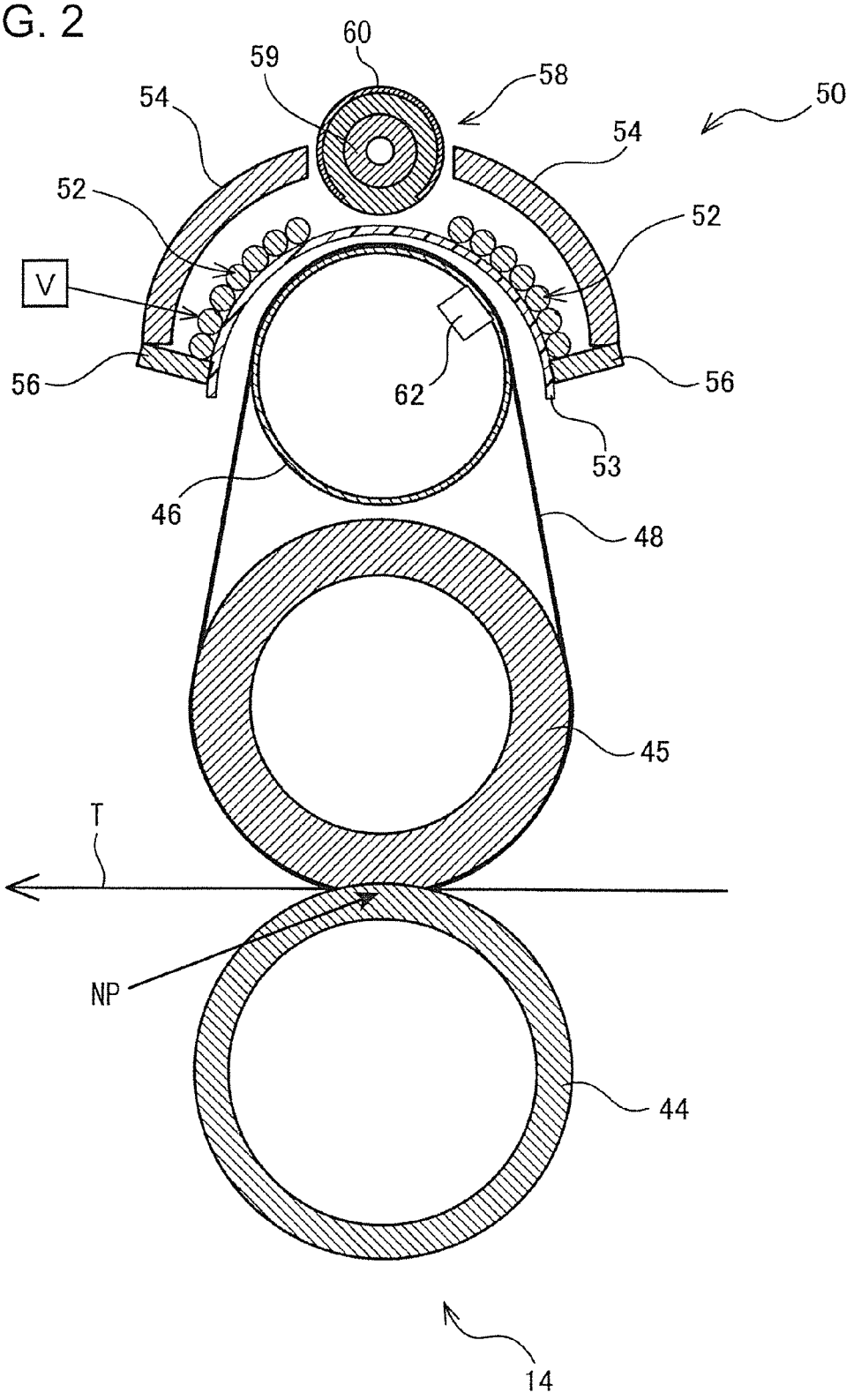
FIG. 2 is a sectional view showing a state where a magnetic shielding body is at a retracted position in a fixing device according to a first embodiment of the present invention.
Figure 3:
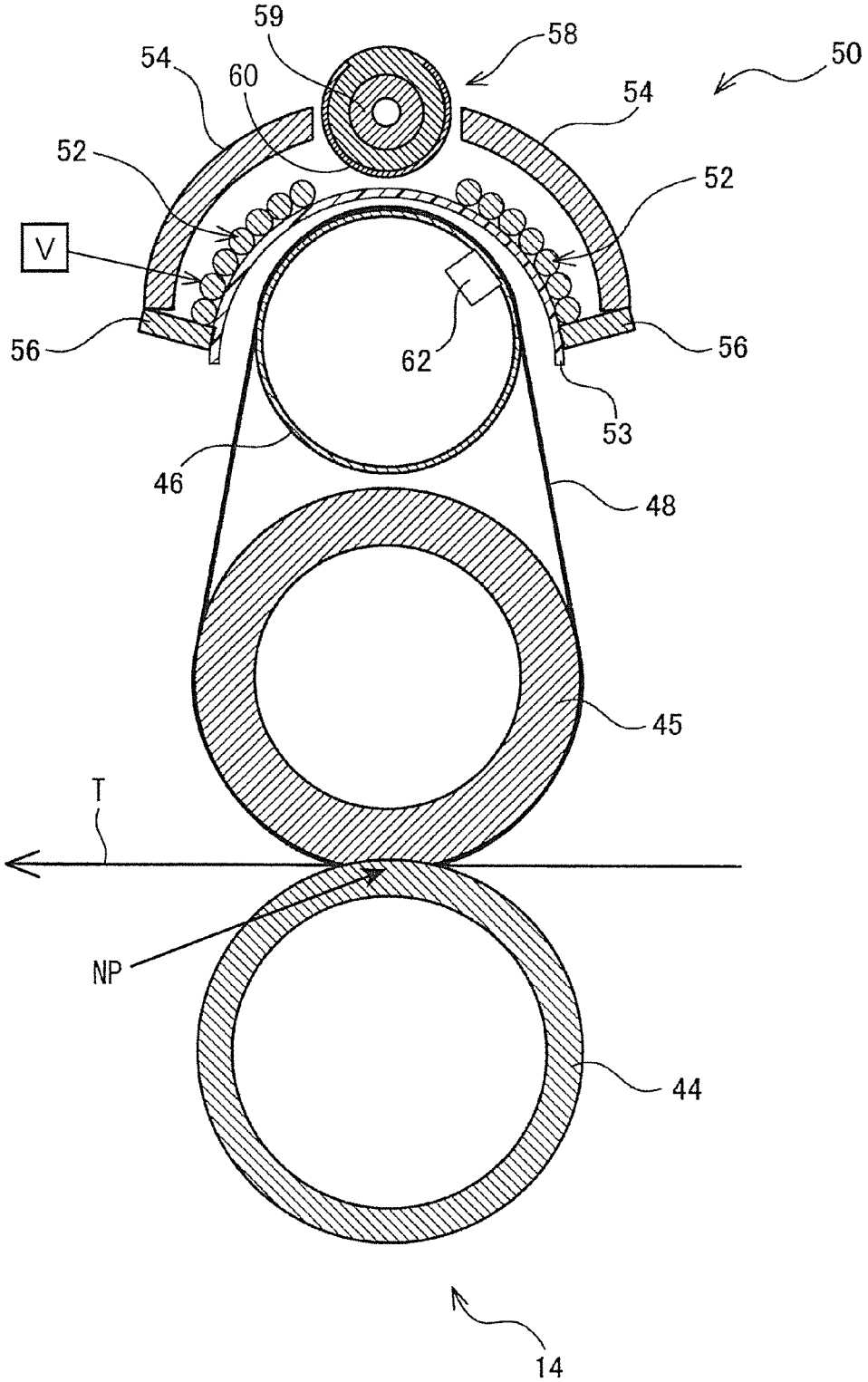
FIG. 3 is a sectional view showing a state where the magnetic shielding body is at a shielding position in the fixing device according to the first embodiment of the present invention.
Figure 4:
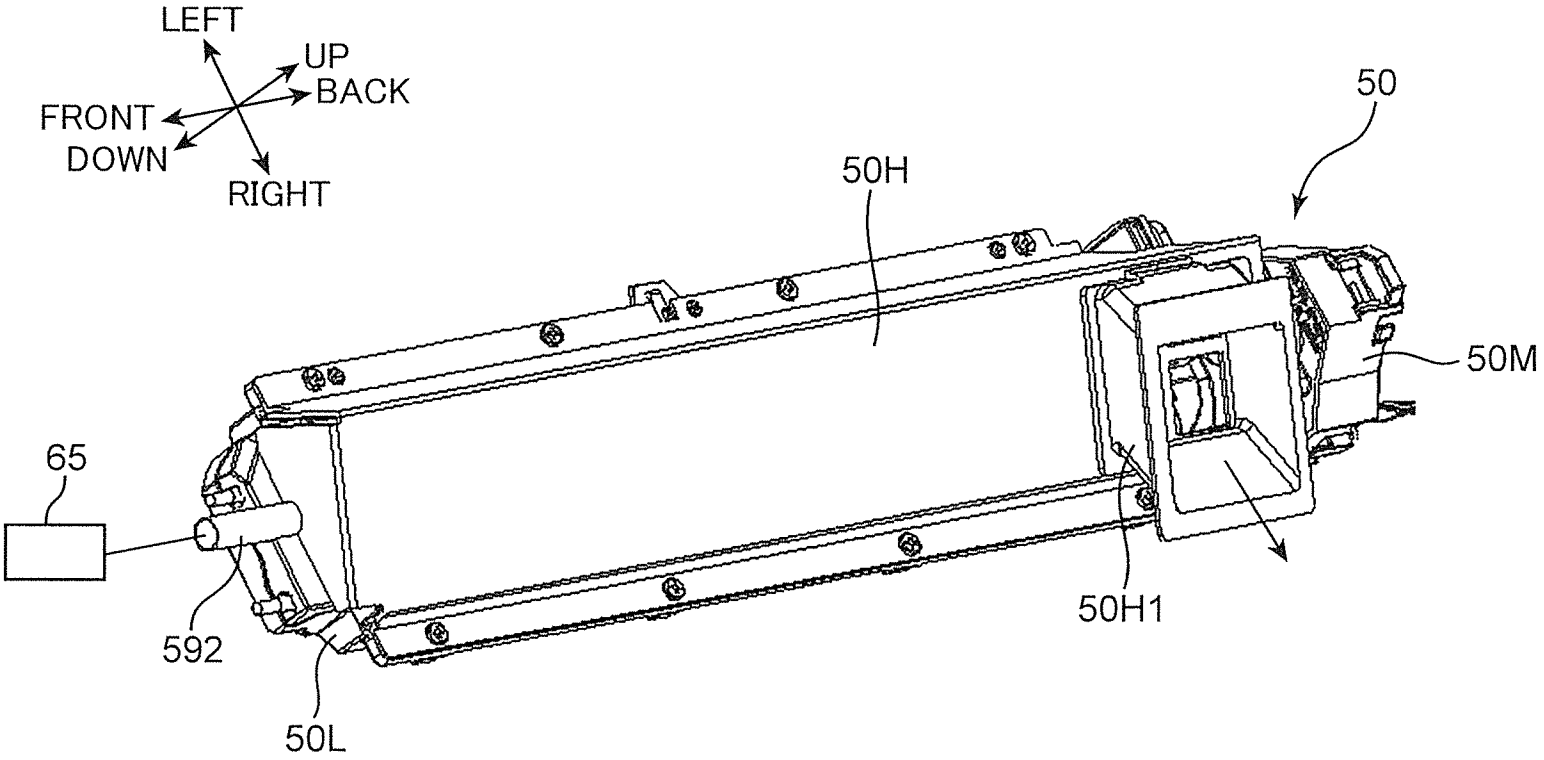
FIG. 4 is a perspective view of an electromagnetic induction heating unit of the fixing device according to the first embodiment of the present invention.
Figure 5:
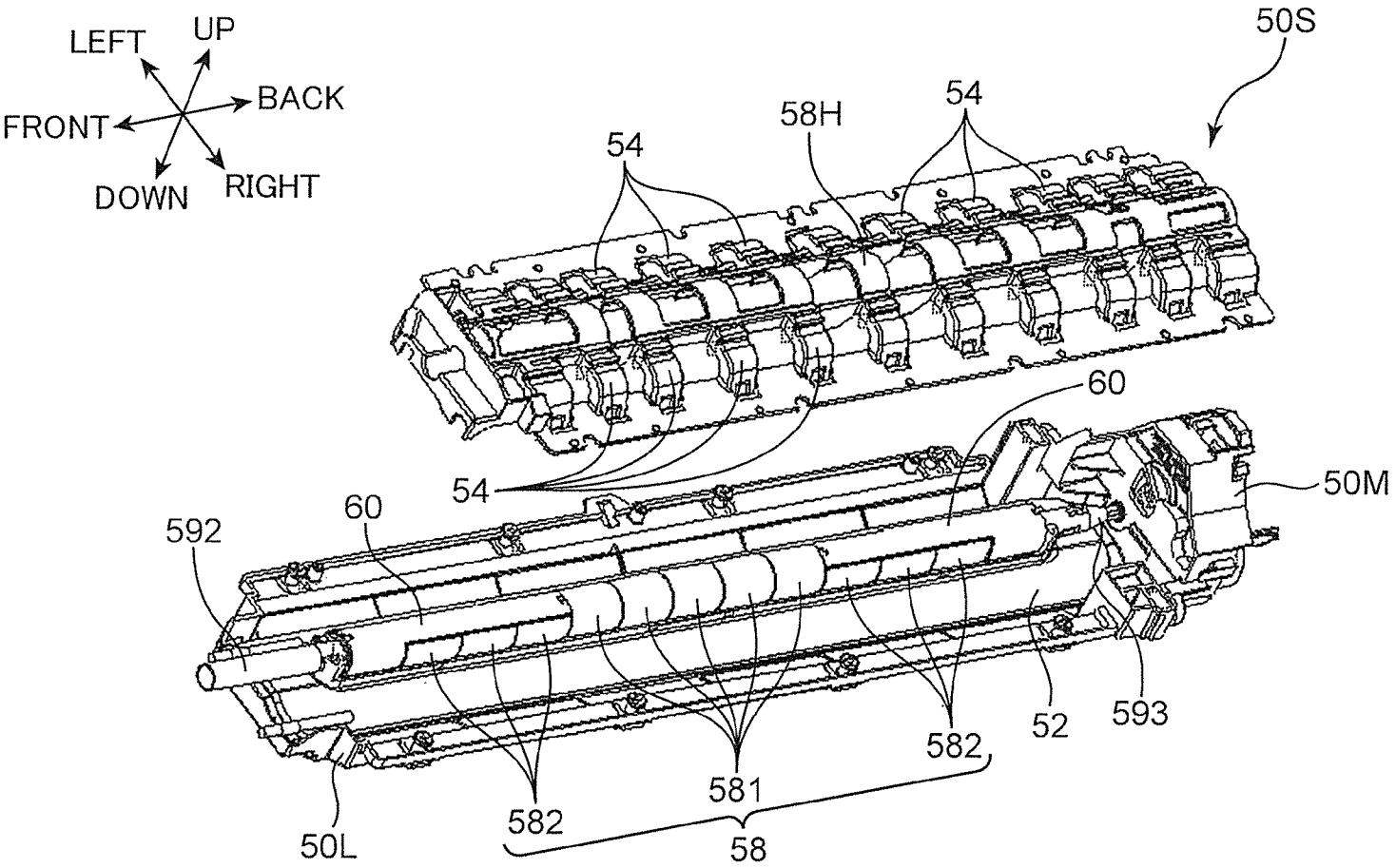
FIG. 5 is an exploded perspective view showing a state in the electromagnetic induction heating unit of the fixing device according to the first embodiment of the present invention.
Figure 6:
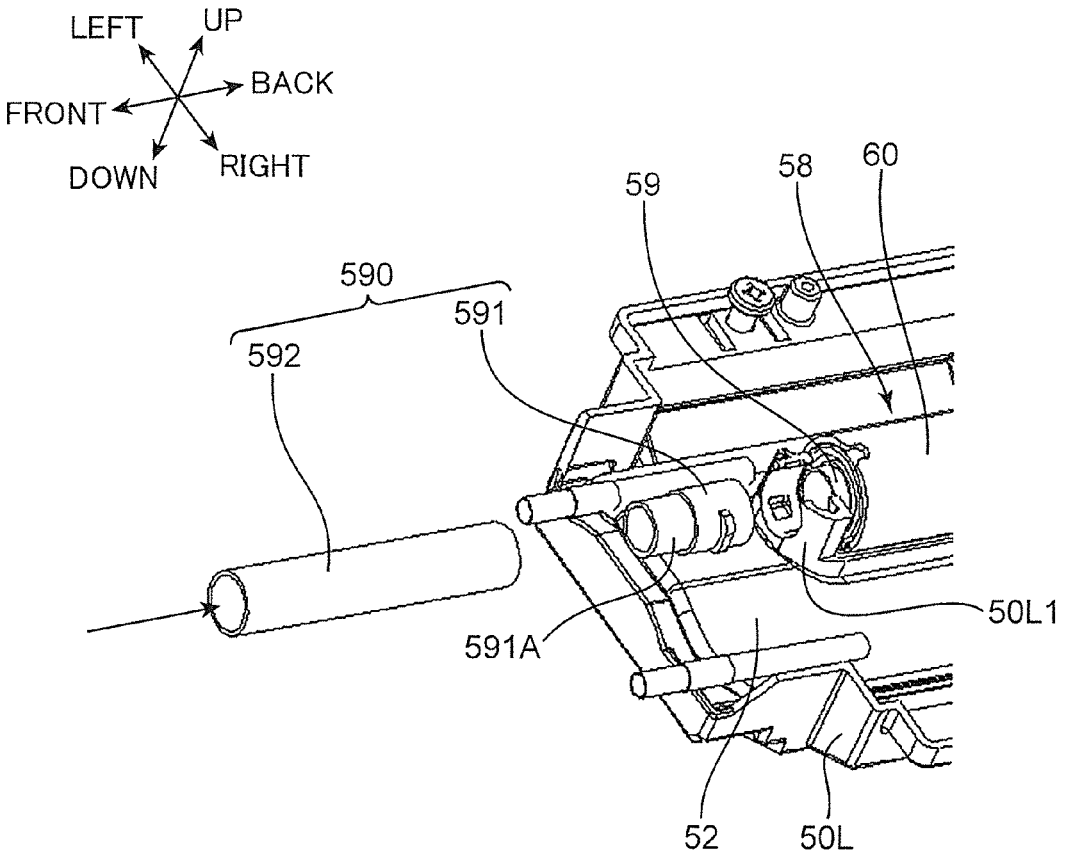
FIG. 6 is an enlarged perspective view showing one axial end side in the electromagnetic induction heating unit of the fixing device according to the first embodiment of the present invention.
Figure 7:
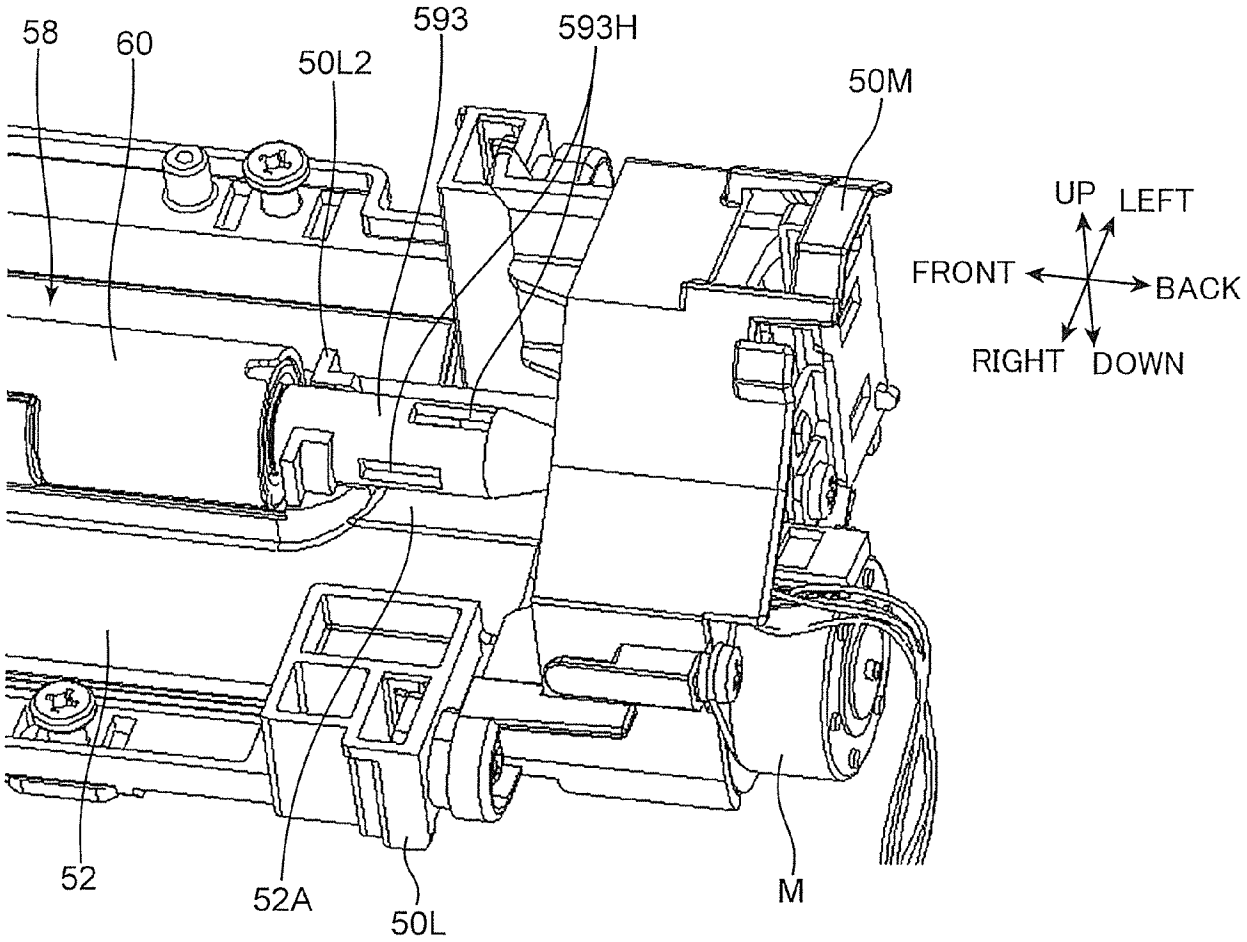
FIG. 7 is an enlarged perspective view showing the other axial end side in the electromagnetic induction heating unit of the fixing device according to the first embodiment of the present invention.
Figure 8:
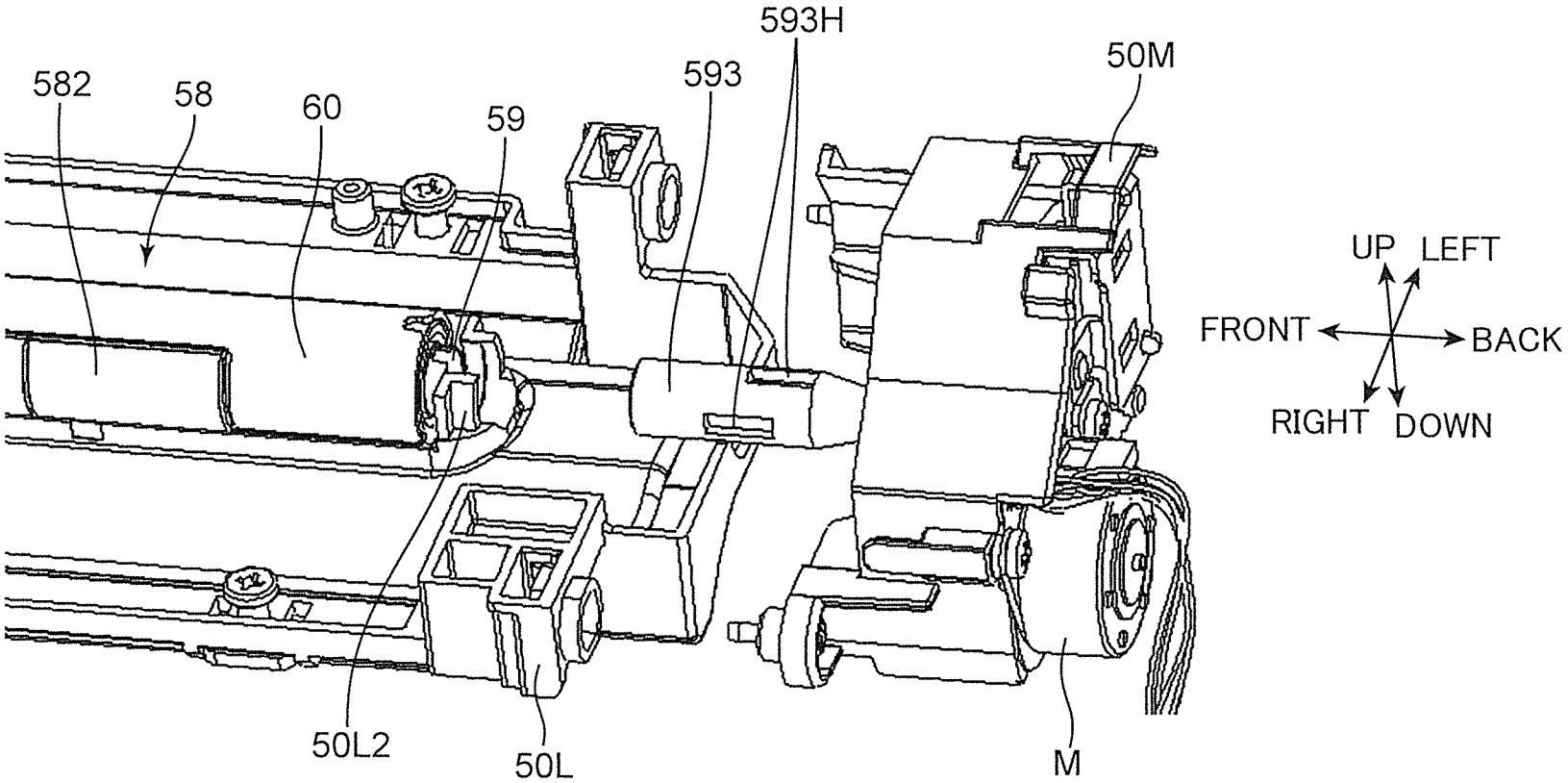
FIG. 8 is an exploded perspective view of the electromagnetic induction heating unit of FIG. 7.
Figure 9A:
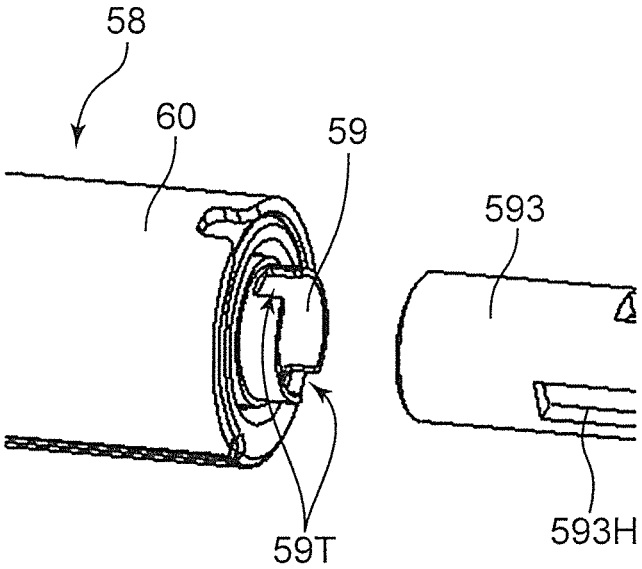
FIG. 9A is a perspective view showing a drive transmission structure to a shaft portion of a second core of the fixing device according to the first embodiment of the present invention.
Figure 9B:
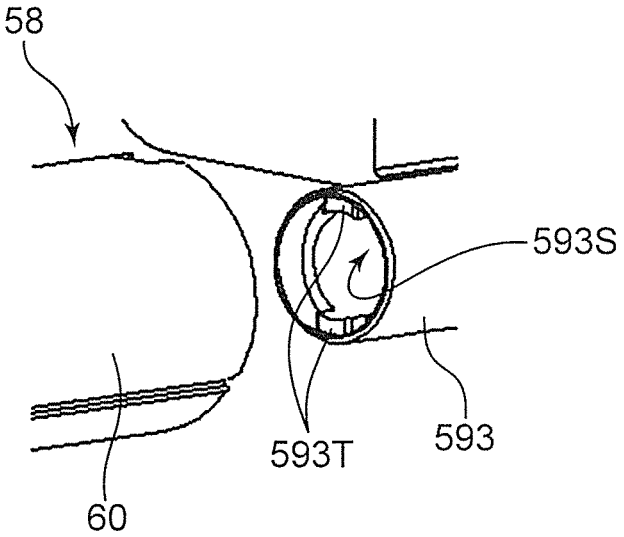
FIG. 9B is a perspective view showing the drive transmission structure to the shaft portion of the second core of the fixing device according to the first embodiment of the present invention.
Figure 10:
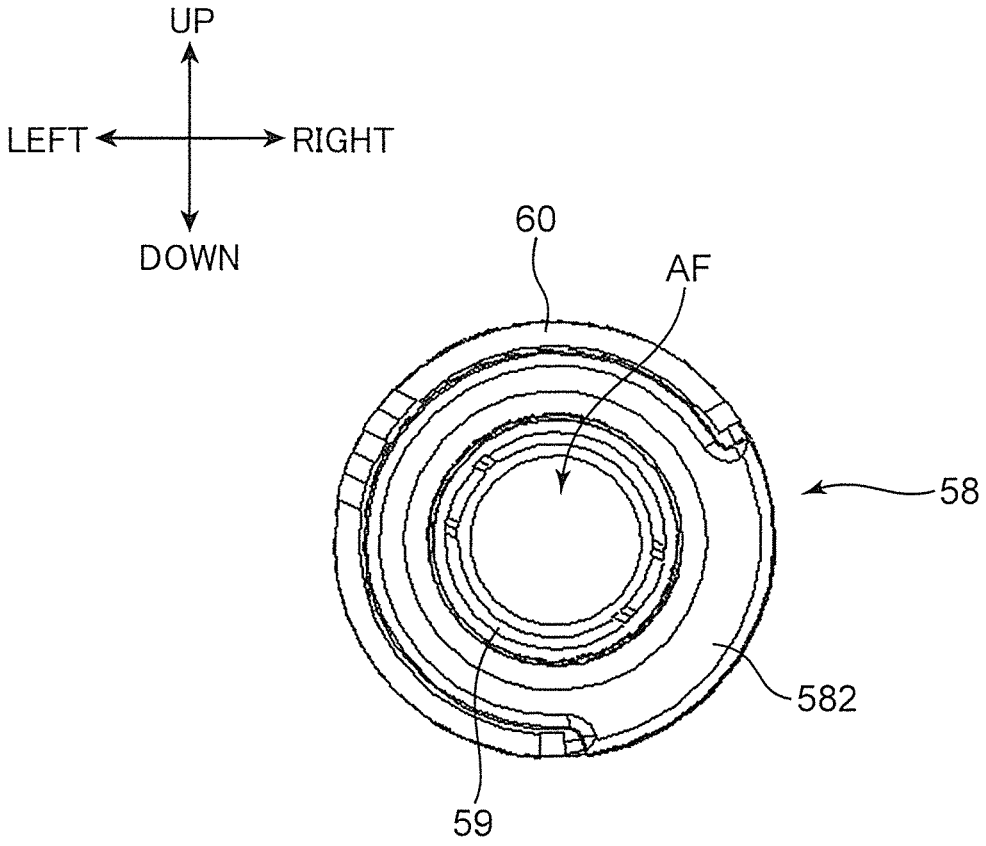
FIG. 10 is a sectional view of the second core of the fixing device according to the first embodiment of the present invention.
Figure 11:
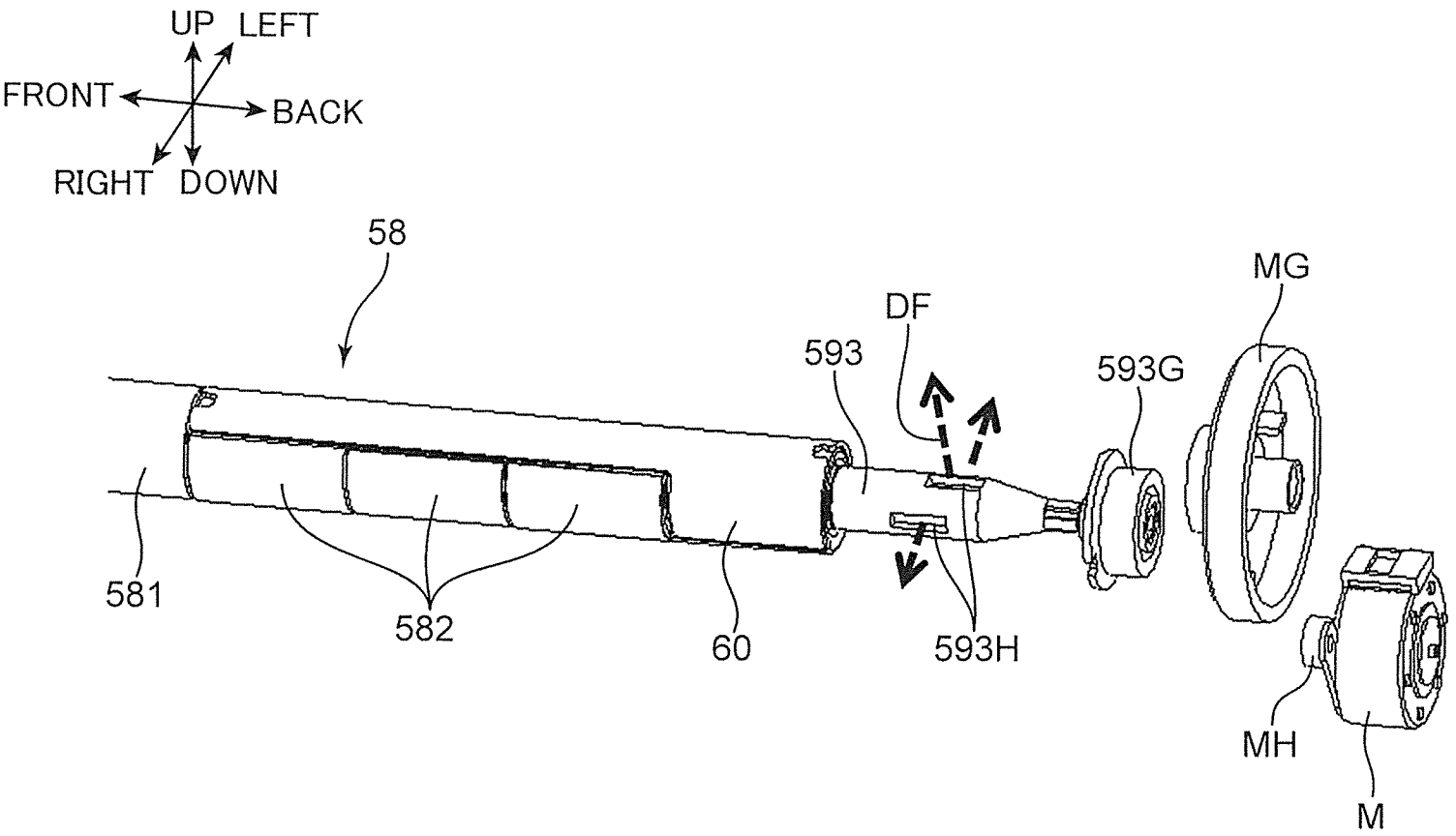
FIG. 11 is an exploded perspective view showing the drive transmission structure to the shaft portion of the second core of the fixing device according to the first embodiment of the present invention.

Next, a fixing device 14 according to a first embodiment of the present invention is described with reference to FIGS. 2 to 11. FIG. 2 is a sectional view showing a state where a magnetic shielding body 60 to be described later is at a retracted position in the fixing device 14 according to the first embodiment of the present invention. FIG. 3 is a sectional view showing a state where the magnetic shielding body 60 is at a shielding position in the fixing device 14. FIG. 4 is a perspective view of a coil unit 50 (electromagnetic induction heating unit) of the fixing device 14. FIG. 5 is an exploded perspective view showing a state in the coil unit 50. FIG. 6 is an enlarged perspective view showing one axial end side (front end side) in the coil unit 50. FIG. 7 is an enlarged perspective view showing the other axial end side (rear end side) in the coil unit 50. FIG. 8 is an exploded perspective view of the coil unit 50 of FIG. 7. In FIG. 8, a drive transmission member 593 and a driving unit 50M to be described later are shifted backward as compared with FIG. 7. FIGS. 9A and 9B are perspective views showing a drive transmission structure to a center core shaft 59 of the fixing device 14. FIG. 10 is a sectional view of a second core 58 of the fixing device 14. FIG. 11 is an exploded perspective view showing the drive transmission structure to the center core shaft 59 of the fixing device 14. Note that direction-indicating terms such as "upper" and "lower", "front" and "back", "left" and "right" used in the following description are merely for the purpose of clarifying the description and do not limit the principle of the fixing device at all.

The fixing device 14 applies a fixing process of fixing a toner image onto a sheet by heating and pressing the toner image transferred onto the sheet. The fixing device 14 includes a pressure roller 44 (second rotary body), a fixing belt 48 (first rotary body), a fixing roller 45, a heat roller 46, the coil unit 50 and a fan 65 (FIG. 4) (air flow generator). These members are supported on an unillustrated frame which is a housing of the fixing device 14.

The pressure roller 44 is a roller member rotatable counterclockwise in FIG. 2 and includes a tubular core member made of, e.g. SUS, an elastic layer made of silicone rubber and laminated on the core member and a surface release layer made of PFA and laminated on the elastic layer. Note that a heat source such as a halogen heater may be arranged inside the pressure roller 44. The elastic layer can be heated by the heat source. The pressure roller 44 is pressed against the fixing belt 48 by an unillustrated biasing member and a nip portion NP, through which a sheet carrying a toner image is passed, is formed between the fixing belt 48 and the pressure roller 44.

The fixing belt 48 is an endless belt wound on the fixing roller 45 and the heat roller 46 to be described later and rotatable clockwise in FIG. 2. The fixing belt 48 has a widthwise dimension in a direction (front-back direction) perpendicular to a conveying direction T of the sheet passed through the nip portion NP. The fixing belt 48 includes a base member made of electroformed nickel and located on the side of the fixing roller 45, an elastic layer made of silicone rubber and laminated on the base member on a side opposite to the fixing roller 45 and a surface release layer made of PFA, laminated on the elastic layer and located on the side of the pressure roller 44. The fixing belt 48 is induction-heated by a magnetic flux generated by the coil unit 50 to be described later.

The fixing roller 45 is a roller member arranged inside the fixing belt 48 in parallel to the pressure roller 44 and rotatable in a clockwise direction which is the same as the rotating direction of the fixing belt 48. The fixing roller 45 includes a tubular core member made of, e.g. SUS, an elastic layer made of silicone rubber and laminated on the core member and a surface release layer made of PFA, laminated on the elastic layer and held in contact with the fixing belt 48. The fixing roller 45 rotates while being held in contact with the inner surface of the fixing belt 48 at a position corresponding to the nip portion NP. This causes the fixing belt 48 to rotate while being sandwiched between the fixing roller 45 and the pressure roller 44 at the nip portion NP.

The heat roller 46 is a roller member arranged inside the fixing belt 48 in parallel to the fixing roller 45 at a position opposite to the pressure roller 44 across the fixing roller 45 and rotatable clockwise in FIG. 2. The heat roller 46 includes a tubular core member made of a magnetic metal such as SUS and a surface release layer made of PFA and laminated on the core member. Note that a thermistor 62 is arranged in the heat roller 46. The thermistor 62 detects a surface temperature of the heat roller 46. The detected surface temperature is transmitted to an unillustrated controller, which controls an alternating current bias power supply V based on that surface temperature and adjusts the density of a magnetic flux generated by the coil 52 to be described later.

Each of the pressure roller 44, the fixing roller 45 and the heat roller 46 has an axial dimension set larger than a maximum width of sheets to be passed through the nip portion NP and the widthwise dimension of the fixing belt 48 is set larger than the maximum width of sheets.

The coil unit 50 induction-heats the fixing belt 48 at a position where the fixing belt 48 is wound around the heat roller 46. The coil unit 50 is arranged above the heat roller 46. With reference to FIGS. 4 and 5, the coil unit 50 includes a supporting unit 50L (housing), a shield 50H (magnetic shield), the driving unit 50M, the coil 52 (magnetic flux generation source), a bobbin 53, an arch core unit 50S, a plurality of pairs of arch cores 54, a pair of side cores 56, the center core 58, the center core shaft 59 and the magnetic shielding body 60.

The supporting unit 50L supports each member of the coil unit 50. As shown in FIG. 5, the supporting unit 50L has a substantially rectangular shape having a predetermined width in a lateral direction and extending in the front-back direction. The supporting unit 50L constitutes a part of the frame of the aforementioned fixing device 14.

The shield 50H (FIG. 4) is mounted on an upper surface part of the supporting unit 50L. The shield 50H is formed by bending a plate member and has a chevron shape. The shield 50H covers the center core 58 and the coil 52 to be described later from above and prevents magnetic or electrical noise from entering the coil unit 50 from the outside of the coil unit 50. The shield 50H includes an exhaust duct 50H1. The exhaust duct 50H1 is a rectangular duct formed on a rear end part of a right wall surface of the shield 50H. The exhaust duct 50H1 has a function of exhausting an air flow discharged from exhaust ports 593H of a drive transmission member 593 to be described later to the outside of the coil unit 50.

The driving unit 50M (FIG. 5) is arranged on a rear end part of the supporting unit 50L. The driving unit 50M is a unit for generating a rotational drive force for rotating the center core 58 to be described later.

The bobbin 53 (FIG. 2) is arranged on a lower surface part of the supporting unit 50L. The bobbin 53 is a member for holding the coil 52 and extends along an axial direction of the heat roller 46 (i.e. width direction of the fixing belt 48). The bobbin 53 is a member formed into a semi-cylindrical shape to extend along the fixing belt 48 at a position opposite to the fixing roller 45. The bobbin 53 extends along an arc beyond the widthwise dimension of the fixing belt 48 and over a substantially half of a circumferential length of the fixing belt 48. The bobbin 53 is at a predetermined distance from the fixing belt 48. A material of the bobbin 53 is a heat resistant resin (e.g. PPS, PET, LCP).

The coil 52 is arranged in a state wound along an extending direction of the bobbin 53 on the hollow semi-cylindrical bobbin 53. A winding area of the coil 52 is set to have a dimension larger than the widthwise dimension of the fixing belt 48. Further, with reference to FIG. 5, the coil 52 is fixed to the bobbin 53 of the supporting unit 50L to surround the center core 58 extending in the axial direction when viewed in a direction perpendicular to the axial direction of the heat roller 46 (from above). The coil 52 is fixed to the bobbin 53, for example, by a silicone-based adhesive. Further, the alternating current bias power supply V (FIG. 2) is connected to the coil 52 and the coil 52 generates a magnetic flux when an alternating current bias is applied thereto.

The arch core unit 50S (FIG. 5) is mounted on the supporting unit 50L from above. At this time, the arch core unit 50S is arranged to cover the coil 52 and the center core 58 from above. Further, the aforementioned shield 50H is arranged above the arch core unit 50S. The arch core unit 50S supports a plurality of arch cores 54.

The arch cores 54 and the side cores 56 are made of a magnetic material such as ferrite and form a magnetic path, along which the magnetic flux generated by the coil 52 passes, together with the fixing belt 48. The arch cores 54 are paired to surround the coil 52 from opposite sides with the center core 58 as a center. The arch cores 54 are formed into an arch shape with the center core 58 interposed while being paired. A plurality of arch cores 54 are arranged at intervals along the axial direction of the center core 58. The plurality of arch cores 54 are arranged also in an area beyond the winding area of the coil 52.

The center core 58 is arranged between upper end parts of the paired arch cores 54. An upper part of the center core 58 is covered by a center core protecting portion 58H (FIG. 5) of the arch core unit 50S. On the other hand, the side cores 56 extending along the extending direction of the bobbin 53 are coupled to lower end parts of the arch cores 54. The arch cores 54 and the side cores 56 are supported by the above arch core unit 50S made of a heat resistant resin (e.g. PPS, PET, LCP). In this embodiment, the arch cores 54 and the side cores 56 constitute a first core.

The center core 58 is a tubular core made of a magnetic material such as ferrite and arranged at a side opposite to the heat roller 46 across the bobbin 53 in FIG. 2 and extends in parallel to the heat roller 46. The center core 58 is facing an area of the bobbin 53 where the coil 52 is absent in a circumferential direction (FIG. 2). The center core shaft 59 is inserted through the center core 58 and the center core 58 rotates clockwise or counterclockwise with the rotation of the center core shaft 59.

The center core shaft 59 is formed of a hollow cylindrical member and holds the center core 58 on a peripheral surface. The center core shaft 59 includes an internal space AF (FIG. 10) extending along the axial direction in a hollow interior. The center core shaft 59 serves as a rotary shaft in the rotation of the center core 58. The center core shaft 59 is formed of a thin pipe (cylindrical tube member) made of nonmagnetic SUS and rotated by a motor M to be described later.

The magnetic flux generated by the coil 52 passes along the magnetic path formed among the fixing belt 48, the side cores 56, the arch cores 54 and the center core 58. The center core 58 is located between the arch cores 54 and the fixing belt 48 when viewed from the magnetic path and the magnetic shielding body 60 is mounted on the outer peripheral surface of the center core 58.

The magnetic shielding body 60 is a thin plate member made of a nonmagnetic material with good electrical conductivity, e.g. oxygen-free copper. The magnetic shielding body 60 is arranged on the peripheral surface of the center core 58. The magnetic shielding body 60 is rotatable between the shielding position and the retracted position with the rotation of the center core 58. The magnetic shielding body 60 is located in the magnetic path formed by the fixing belt 48, the side cores 56, the arch cores 54 and the center core 58, i.e. faces the fixing belt 48, and shields or suppresses the magnetic flux when being at the shielding position (FIG. 3). On the other hand, the magnetic shielding body 60 is retracted from the magnetic path, i.e. moves to a position not facing the fixing belt 48, and neither shields nor suppresses the magnetic flux when being at the retracted position (FIG. 2).

With reference to FIG. 5, the center core 58 is actually divided into a plurality of pieces in the axial direction and composed of a first center core 581 (central core portion) and a pair of second center cores 582 (outer core portions). The first center core 581 is arranged around the center core shaft 59 over the entire circumference in an axial central part of the center core shaft 59. The first center core 581 forms a magnetic path in accordance with a first sheet width of sheets which pass through the nip portion NP (FIG. 2). The second center cores 582 are adjacent to the first center core 581 at axially outer sides and arranged around the center core shaft 59 while being partially exposed in the circumferential direction (FIG. 10). The second center cores 582 form a magnetic path in accordance with a second sheet width larger than the first sheet width together with the first center core 581.

Note that the first center core 581 and the second center cores 582 are formed by adjacently arranging a plurality of cylindrical tube members mounted on the peripheral surface of the center core shaft 59 in the axial direction as shown in FIG. 5. Note that the first center core 581 and the second center cores 582 may also be formed by mounting a plurality of arched members on the peripheral surface of the center core shaft 59.

The magnetic shielding body 60 is arranged in the same areas as the second center cores 582 at least in the axial direction. As shown in FIG. 10, the magnetic shielding body 60 is arranged to cover areas different from areas where the second center cores 582 are exposed in the circumferential direction. In other words, the areas where the second center cores 582 are exposed to a radially outer side are set by covering parts of the peripheral surfaces of the second center cores 582 by the magnetic shielding body 60.

The division of the center core 58 and the magnetic shielding body 60 is determined according to the size of a sheet to be passed through the nip portion NP. Specifically, an axial dimension from a front end side of the first center core 582 to a rear end side thereof is determined to correspond to sheets having the first sheet width size (e.g. A4 sheets longitudinal). On the other hand, an axial dimension from the second center core 582 on a front end side to the second center core 582 on a rear end side is determined to correspond to sheets having the second sheet width size larger than the first sheet width (e.g. A3 sheets). Note that the center core 58 and the magnetic shielding body 60 may be divided in a plurality of patterns in the circumferential direction and the axial direction in accordance with further different sheet widths.

Note that the plurality of arch cores 54 are arranged along the axial direction of the center core 58 as described above and an arrangement density of the pairs of arch cores 54 is determined according to a magnetic flux density (magnetic field intensity) distribution of the coil 52. By appropriately arranging the arch cores 54 and the side cores 56, the magnetic flux density distribution (temperature difference) in the axial direction of the heat roller 46 (width direction of the fixing belt 48) is uniformized.

The fan 65 (FIG. 4) is a fan mounted on the unillustrated frame of the fixing device 14. The fan 65 generates an air flow flowing from the front side toward the rear side in the internal space AF of the center core shaft 59 by being rotated by the unillustrated controller.

Further, the coil unit 50 includes an introducing portion (FIG. 6) and the drive transmission member 593 (transmitting portion). Further, with reference to FIG. 11, the driving unit 50M includes the motor M and a transmission gear MG.

The introducing portion 590 is mounted on a front end part (one axial end side) of the center core shaft 59 and introduces an air flow into the internal space AF. The introducing portion 590 includes a front bearing 591 (bearing member) and an introducing tube 592 (introducing tube). The front bearing 591 is made of a hollow cylindrical heat resistant material. The front bearing 591 rotatably supports the front end part of the center core shaft 59. With reference to FIG. 6, the front bearing 591 is mounted in a U-shaped front supporting portion 50L1 formed on the front side of the supporting unit 50L. An end part of the center core shaft 59 slightly projecting from the front end part of the center core 58 (magnetic shielding body 60) is inserted into the front bearing 591. As a result, the center core shaft 59 is rotatably supported on the front bearing 591 in a state where the front bearing 591 is fixed. Thus, even if the center core shaft 59 and the front bearing 591 rub against each other with the rotation of the center core shaft 59, the deformation and breakage of the front bearing 591 are prevented since the front bearing 591 is made of the heat resistant material. Note that a cylindrical interior of the front bearing 591 communicates with the internal space AF.

The introducing tube 592 is mounted on a small-diameter portion 591A of the front bearing 591 and introduces the air flow toward the internal space AF via the front bearing 591. A front end side of the introducing tube 592 communicates with the fan 65. Since the introducing tube 592 is formed of a deformable elastic tube, a later-described introduction path for the air flow is easily arranged.

The drive transmission member 593 is coupled to the motor M via the transmission gear MG and mounted on a rear end side (other axial end side) of the center core shaft 59. The drive transmission member 593 transmits a rotational drive force of the motor M to the center core shaft 59. The drive transmission member 593 is formed of a substantially hollow cylindrical member and has a communication space 593S (FIG. 9B) inside. When the drive transmission member 593 is mounted on the center core shaft 59, the communication space 593S communicates with the internal space AF. Note that the communication space 593S extends in the axial direction from a front end part of the drive transmission member 593 to an area facing exhaust ports 593H to be describe later from a radially inner side.

With reference to FIGS. 9A and 9B, an end part of the center core shaft 59 slightly projecting from the rear end part of the center core shaft 58 (magnetic shielding body 60) is inserted into the drive transmission member 593. At this time, a pair of projections 593T formed on a front end part of an inner peripheral part of the drive transmission member 593 are engaged with a pair of cut portions 59T formed on the rear end part of the center core shaft 59. As a result, the center core shaft 59 and the drive transmission member 593 are made integrally rotatable. Note that the drive transmission member 593 is rotatably supported in a substantially U-shaped rear supporting portion 50L2 (FIG. 8) formed on a rear end part of the supporting unit 50L. Further, the drive transmission member 593 includes a gear portion 593G (FIG. 11) and the exhaust ports 593H.

The gear portion 593G is a gear fixed to a rear end part of the drive transmission member 593. The gear portion 593G is engaged with the transmission gear MG to be described later.

The exhaust port 593H is a long and narrow opening communicating with the communication space 593S and open on the outer peripheral surface of the drive transmission member 593. A plurality of exhaust ports 593H are arranged in the circumferential direction as shown in FIG. 11. The respective exhaust ports 593H are arranged while being displaced in the axial direction. Thus, the air flow ejected from each exhaust port 593H can cool members around the drive transmission member 593 in a range wide in the axial direction.

With reference to FIG. 7, the exhaust ports 593H rotate about the center core shaft 59 above an end adjacent area 52A of the coil 52. Here, the end adjacent area 52A is an area of the coil 52 adjacent to the axial rear end part of the center core 58 in the axial direction and a part where a coil wire of the coil 52 extends in the lateral direction.

The motor M (FIG. 11) is a motor for generating a rotational drive force for rotating the center core 58 (center core shaft 59). The motor M includes an output shaft MH. The transmission gear MG is a gear rotatably supported in the driving unit 50M. The transmission gear MG is coupled to the output shaft MH of the motor M and transmits the rotational drive force to the drive transmission member 593. The transmission gear MG is engaged with the gear portion 593G of the drive transmission member 593.

When an image forming operation is started in the image forming apparatus 1, the center core 58 is rotated according to the sheet width of a sheet to be used. As a result, the center core 58 is arranged in the magnetic path in accordance with a sheet passage area and the magnetic shielding body 60 is arranged in sheet non-passage areas. The fixing belt 48 is induction-heated by the magnetic flux passing along the magnetic path formed by the fixing belt 48, the arch cores 54, the side cores 56 and the center core 58. As a result, a toner image is fixed to the sheet passing through the nip portion. Further, unnecessary temperature increases of the fixing belt 48 and the coil unit 50 in the sheet non-passage areas are prevented. Particularly, when the magnetic shielding body 60 enters the magnetic path with the rotation of the center core 58, the magnetic flux axially outwardly of the first center core 581 is shielded or suppressed. Accordingly, when a sheet having the first sheet width passes through the nip portion NP, temperature increases of the coil 52 and the center core 58 in the sheet non-passage areas are suppressed. On the other hand, with the rotation of the center core 58, the second center cores 582 enter the magnetic path, thereby forming the magnetic path in accordance with the second sheet width. As a result, the fixing process can be applied to sheets having different widths while suppressing an excessive temperature increase of each member of the fixing device 14.

Further, in this embodiment, the unillustrated controller rotates the fan 65 (FIG. 4), whereby the air flow flows in the internal space AF (FIG. 10) of the center core shaft 59. As a result, the center core 58 and the magnetic shielding body 60 are cooled via a wall surface of the center core shaft 59. Accordingly, a temperature increase of the center core 58 due to the heat generation of the center core 58 itself is prevented and a temperature increase of the coil 52 arranged around the center core 58 due to radiation heat from the fixing belt 48 is suppressed. This prevents insulation breakdown due to the melting of a coating of the coil wire (Litz wire) of the coil 52 and the breakage of the coil 52 associated with a temperature increase. Further, the breakage of the alternating current bias power supply V (FIG. 2) due to an abnormal change of an inductance value of the coil 52 is prevented. As just described, in this embodiment, a cooling mechanism for cooling the center core 58 and the coil 52 is arranged in a compact manner utilizing the interior of the center core shaft 59 of the center core 58.

Further, according to the above configuration, the air flow is introduced into the front end side (one end side) of the internal space AF of the center core shaft 59 by the introducing portion 590 (FIG. 6). Further, the air flow is exhausted from the exhaust ports 593H of the drive transmission member 593 arranged on the rear end side (other end side) of the center core shaft 59. Thus, the flow of air in one direction can be formed in the internal space AF and the center core 58 can be stably cooled. Further, as the exhaust ports 593H rotate about the center core shaft 59, the air flow coming out from the exhaust ports 593H is blown to the end adjacent area 52A (FIG. 7) of the coil 52. As a result, parts of the coil 52 axially outwardly of the center core 58 can be effectively cooled.

Figure 12:
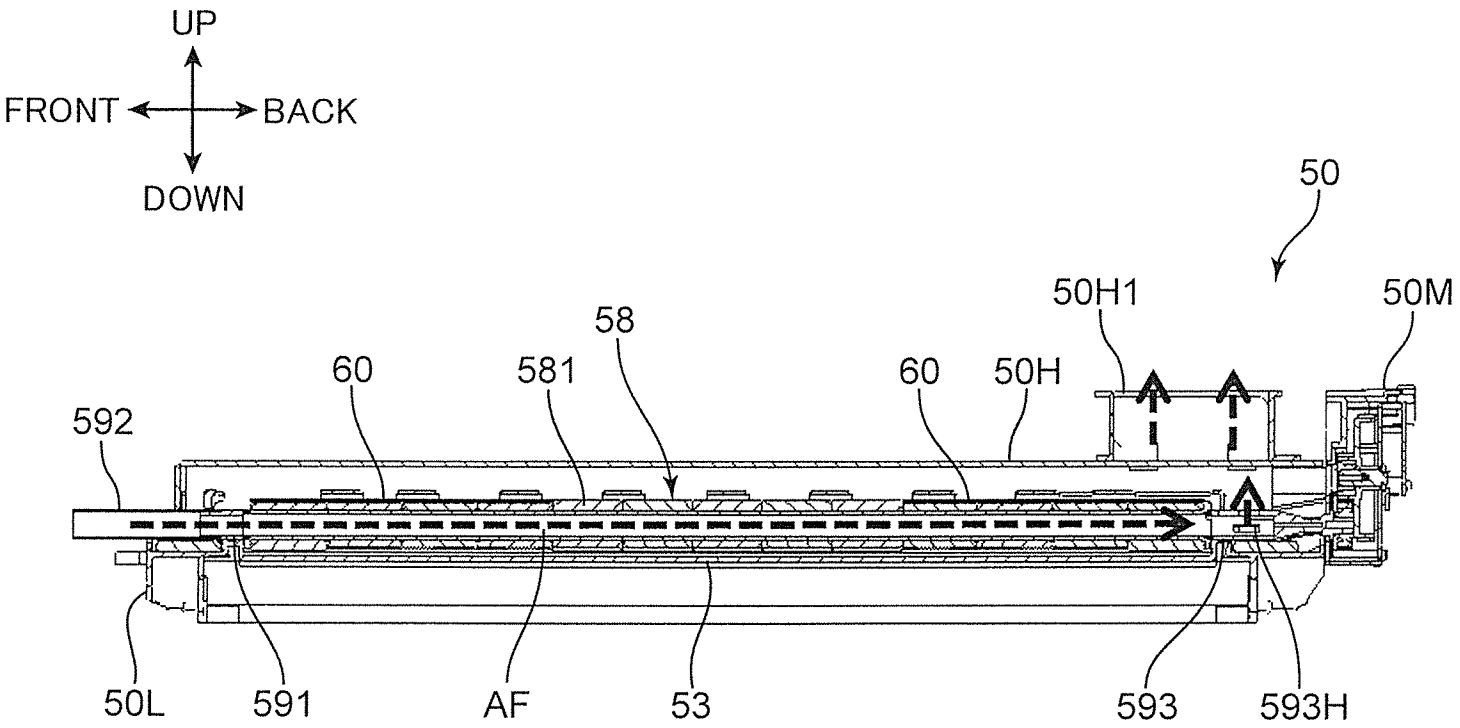
FIG. 12 is a side sectional view of the electromagnetic induction heating unit of the fixing device according to the first embodiment of the present invention.

Furthermore, in this embodiment, with reference to FIG. 11, in the case where a sheet having the first sheet width passes through the nip portion NP (FIG. 3), the second center cores 582 are retracted upwardly from the magnetic path and the magnetic shielding body 60 is arranged in the magnetic path when the center core 58 is rotated about the center core shaft 59. Specifically, the center core 58 of FIG. 11 is rotated by 180° about the center core shaft 59. At this time, one exhaust port 593H is arranged to face the end adjacent area 52A of the coil 52. The air flow ejected downwardly from the above exhaust port 593H (arrow DF of FIG. 11, actually downward facing) is exhausted from the exhaust duct 50H1 (FIGS. 4 and 12) after cooling the coil wire around the end adjacent area 52A. Thus, parts of the center core shaft 59, the center core 58 and the coil 52 corresponding to the sheet non-passage areas can be effectively cooled. Thus, even if heat is transferred to the center core 58 and the coil 52 from the sheet non-passage areas of the fixing belt 48 heated by the previously performed fixing operation, temperature increases of the center core 58 and the coil 52 can be suppressed. Further, since the exhaust duct 50H1 is formed on the same rear end side as the exhaust ports 593H, the air flow ejected from the exhaust ports 593H can be quickly exhausted from the fixing device 14.

Figure 13A:
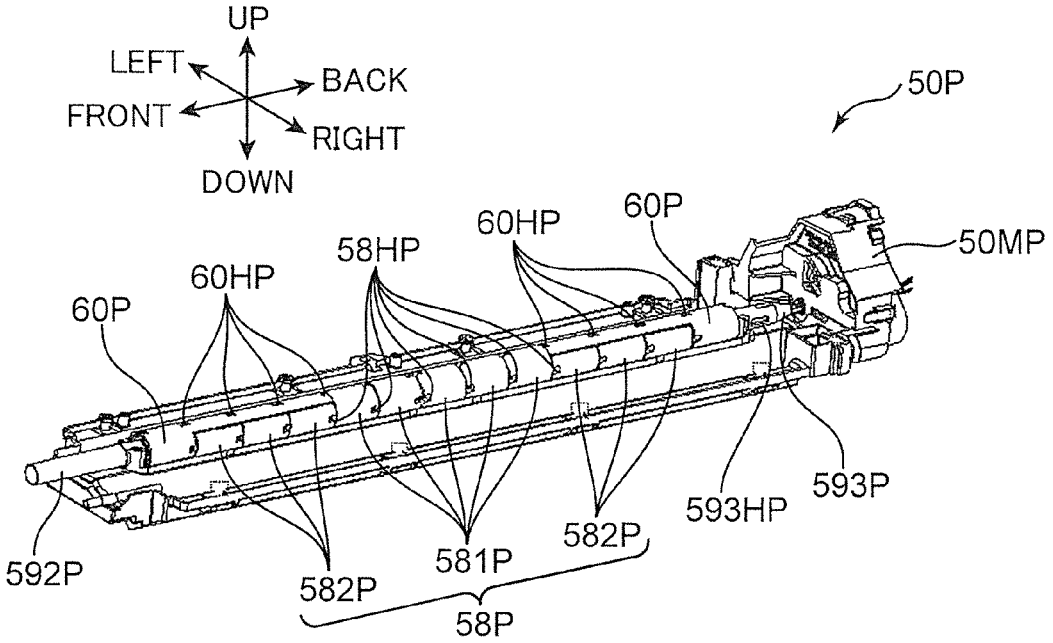
FIG. 13A is a perspective view showing a state in an electromagnetic induction heating unit of a fixing device according to a second embodiment of the present invention.
Figure 13B:
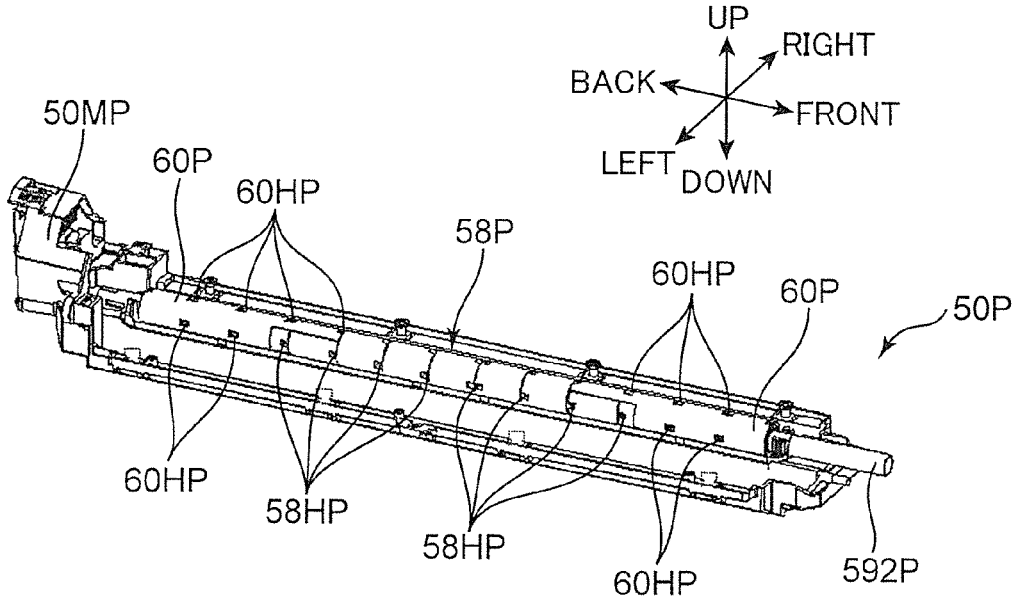
FIG. 13B is a perspective view showing the state in the electromagnetic induction heating unit of the fixing device according to the second embodiment of the present invention.
Figure 14:
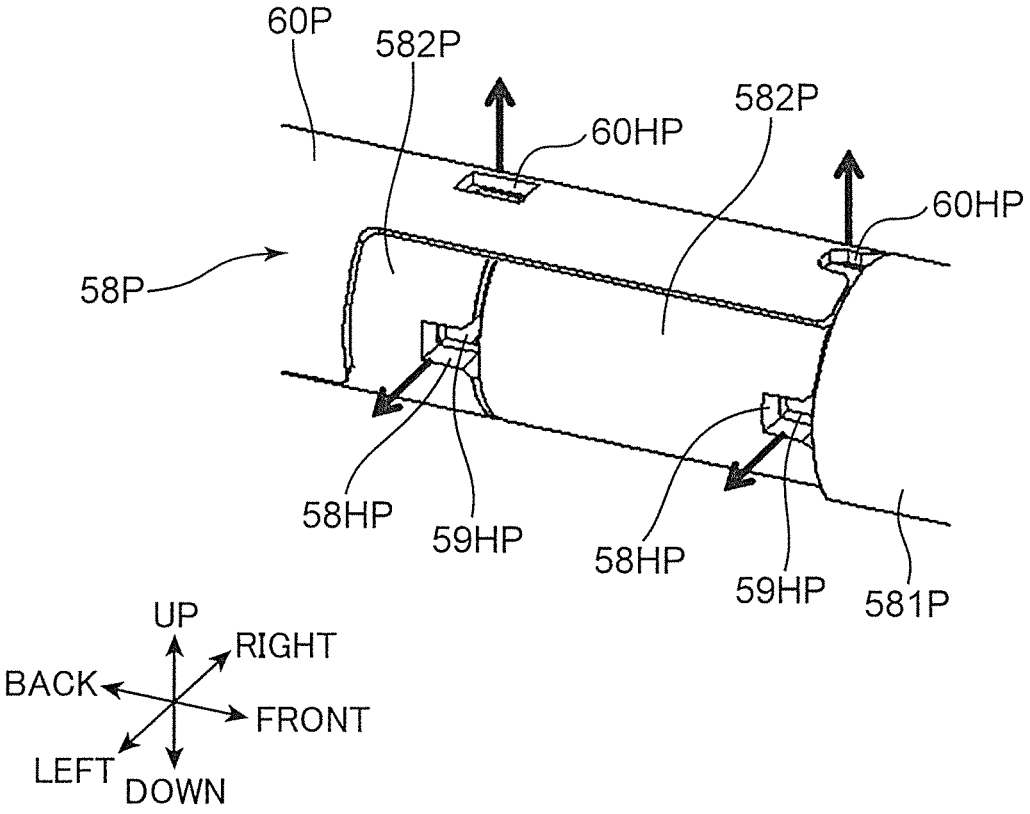
FIG. 14 is an enlarged perspective view showing a peripheral surface of a second core of the fixing device according to the second embodiment of the present invention.

Next, a coil unit 50P according to a second embodiment of the present invention is described with reference to FIGS. 13A, 13B and 14. The coil unit 50P is mounted in the fixing device 14 similarly to the coil unit 50 according to the previous embodiment. FIGS. 13A and 13B are perspective views showing a state in the coil unit 50P. FIG. 14 is an enlarged perspective view showing a peripheral surface of a center core 58P of the coil unit 50P. This embodiment differs from the coil unit 50 according to the previous first embodiment in that the center core 58P and a magnetic shielding body 60P include hole portions (58HP, 59HP, 60HP). Thus, the description is centered on this point of difference and common points are not described. Further, in FIGS. 13A, 13B and 14, members having structures and functions common to the coil unit 50 of the previous first embodiment are denoted by reference signs obtained by adding P in the ends of the same reference signs as in the first embodiment.

With reference to FIGS. 13A, 13B and 14, the hole portions 58HP and 60HP are formed on the peripheral surfaces of the center core 58P and the magnetic shielding body 60. These hole portions communicate with an internal space of a center core shaft (not shown) and are open on the peripheral surface of the center core 58P or the magnetic shielding body 60P through a wall surface of the center core shaft between front and rear end parts of the center core shaft. Further, as shown in FIGS. 13A and 13B, a plurality of hole portions 58HP and 60HP are arranged at intervals in the circumferential and axial directions. Specifically, a plurality of hole portions 58HP are formed on peripheral surfaces of a first center core 581P and second center cores 582P of the center core 58P. Note that the hole portion 58HP is formed of a cut portion formed on one adjacent end edge of the first center core 581P or the second center core 582P formed of a cylindrical tube member (FIG. 14). Thus, the hole portions can be formed utilizing clearances between adjacent first and second center cores 581P and 582P and an air flow can be caused to flow out. Note that the hole portions 59HP (FIG. 14) formed on the center core shaft are facing the respective hole portions 58HP and 60HP from a radially inner side.

According to such a configuration, a part of the air flow flowing in the internal space of the center core shaft can be caused to flow out to outer sides of the center core 58P and the magnetic shielding body 60P from the hole portions 58HP and 60HP. The air flow flowing out cools a coil (not shown) arranged to surround the center core 58P. Thus, an effect of cooling the center core 58P and the coil can be increased in a wide range. Particularly, the plurality of hole portions 58HP and 60HP are arranged at intervals in the circumferential and axial directions. Thus, the effect of cooling the center core 58P and the coil can be further increased.

Figure 15A:
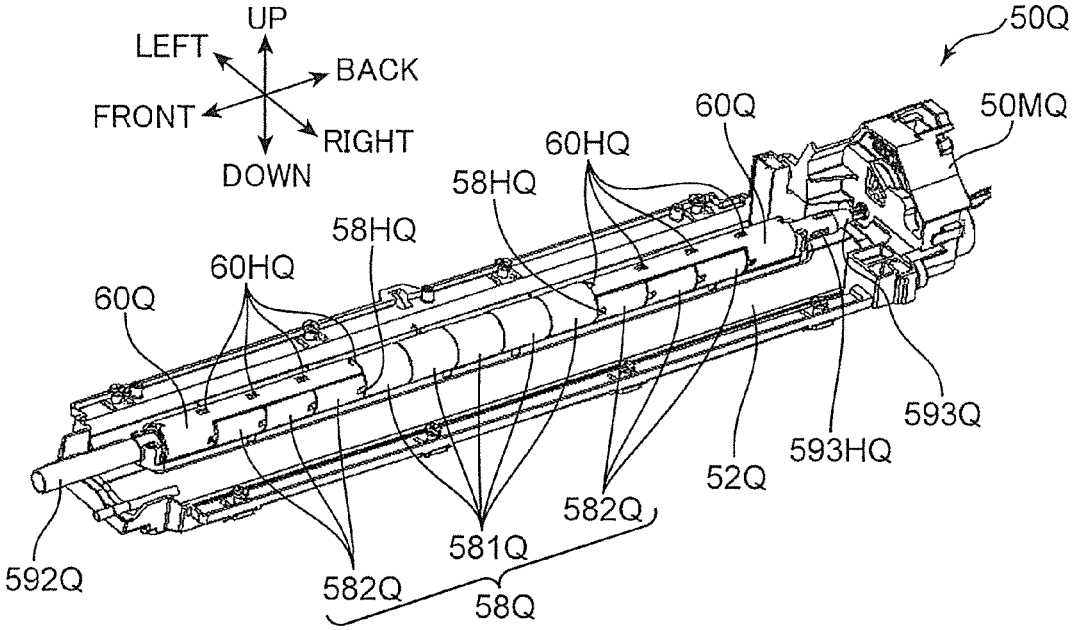
FIG. 15A is a perspective view showing a state in an electromagnetic induction heating unit of a fixing device according to a third embodiment of the present invention.
Figure 15B:
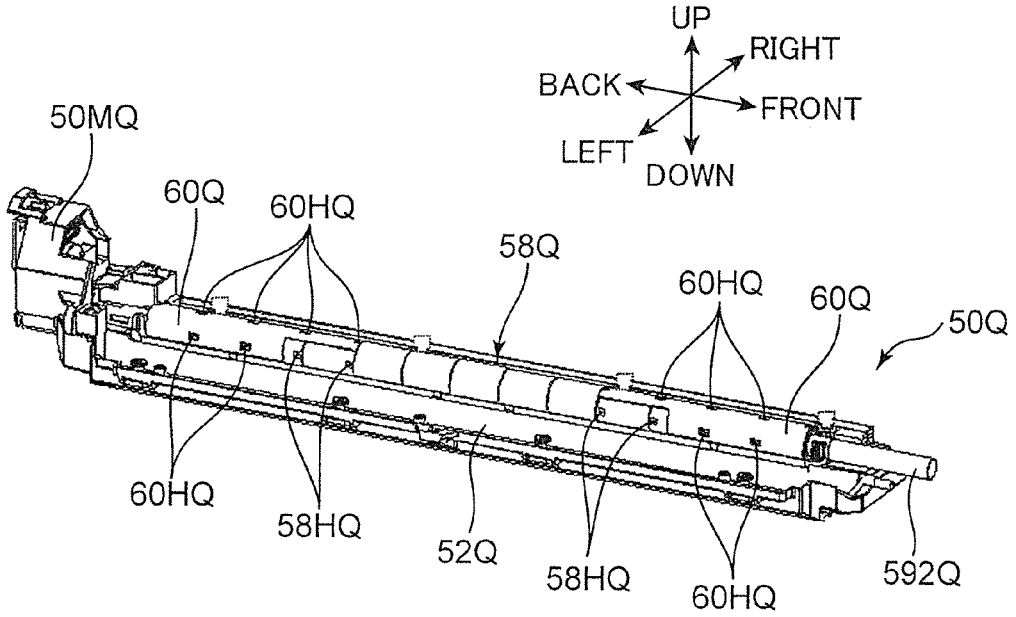
FIG. 15B is a perspective view showing the state in the electromagnetic induction heating unit of the fixing device according to the third embodiment of the present invention.

Next, a coil unit 50Q according to a third embodiment of the present invention is described with reference to FIGS. 15A and 15B. The coil unit 50Q is mounted in the fixing device 14 similarly to the coil unit 50 according to the previous embodiment. FIGS. 15A and 15B are perspective views showing a state in the coil unit 50Q. This embodiment differs from the coil unit 50P according to the previous second embodiment in the arrangement of hole portions 58HQ. Thus, the description is centered on this point of difference and common points are not described. Further, in FIGS. 15A and 15B, members having structures and functions common to the coil unit 50 of the previous first embodiment are denoted by reference signs obtained by adding Q in the ends of the same reference signs as in the first embodiment.

With reference to FIGS. 15A and 15B, the hole portions 58HQ and 60HQ are formed on peripheral surfaces of second center cores 582Q of a center core 58Q and a magnetic shielding body 60. On the other hand, no hole portion is formed on a peripheral surface of a first center core 581Q. In other words, the hole portions 58HQ and 60HQ are arranged in areas axially outwardly of the first center core 581Q. An area corresponding to the first center core 581Q serves as a sheet passage area when a sheet passes through the nip portion NP of the fixing device 14 regardless of a sheet width. Thus, a fixed amount of heat is constantly transferred from a belt surface of the fixing belt 48 facing the first center core 581Q. On the other hand, the areas axially outwardly of the first center core 581Q may serve as sheet non-passage areas and heat from the belt surface of the fixing belt 48 is less likely to be consumed. Thus, the center core 58Q and a coil 52Q tend to be warmed by the fixing belt 48. Thus, by arranging the hole portions at axially outer sides of the first center core 581Q as described, the second center cores 582Q, the magnetic shielding body 60Q and, further, the surrounding coil 52Q can be effectively cooled.

The fixing device 14 and the image forming apparatus 1 provided with the same according to the embodiments of the present embodiment have been described above. According to these inventions, a temperature increase of the center core 58, 58P, 58Q is prevented and a temperature increase of the coil (magnetic flux generation source) arranged around each center core is suppressed. As a result, the process of fixing the toner to the sheet is stably realized. Note that the present invention is not limited to these embodiments and, for example, the following modifications can be adopted.

Figure 16:
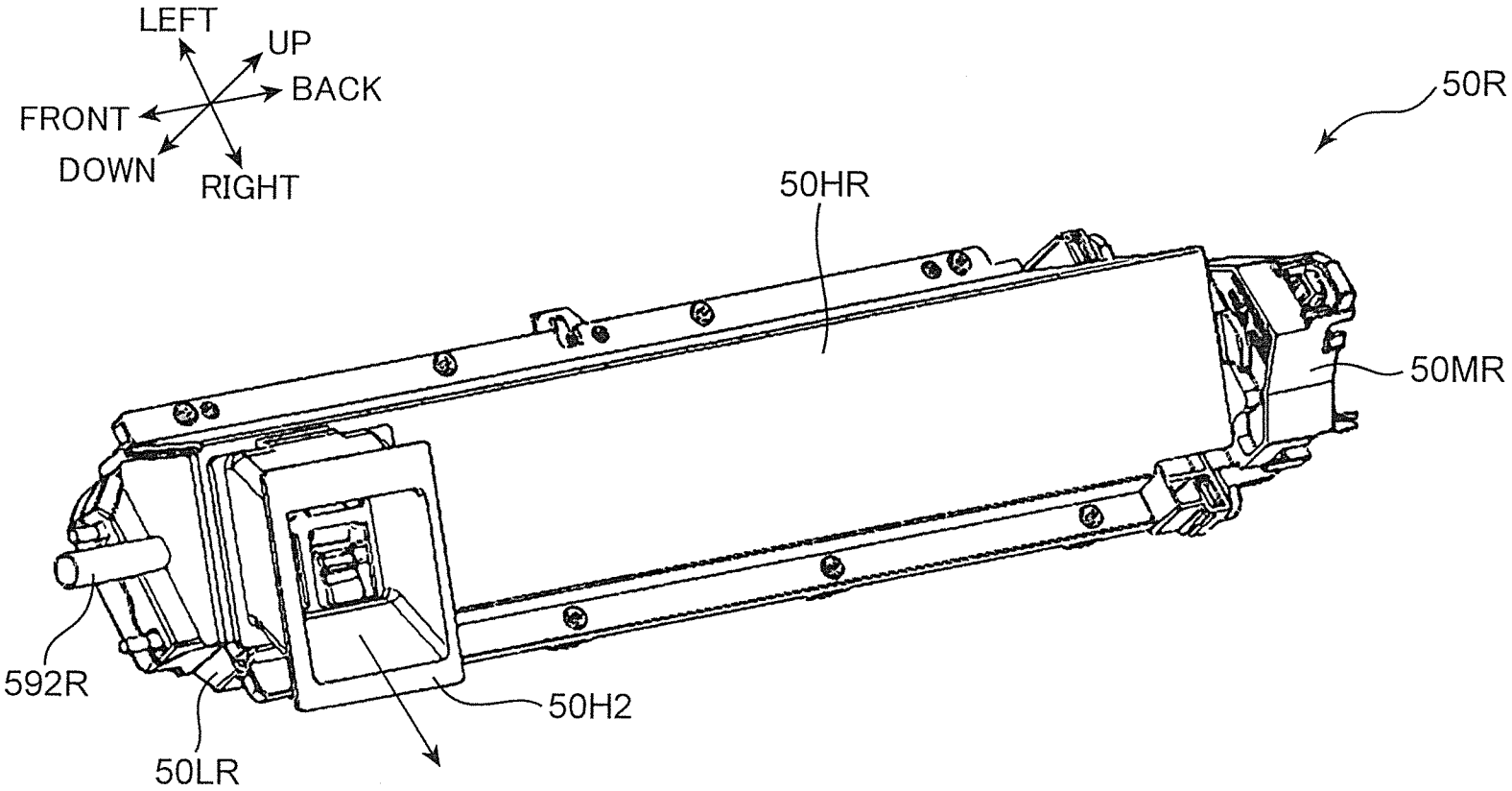
FIG. 16 is a perspective view of an electromagnetic induction heating unit of a fixing device according to a modification of the present invention.
Figure 17:
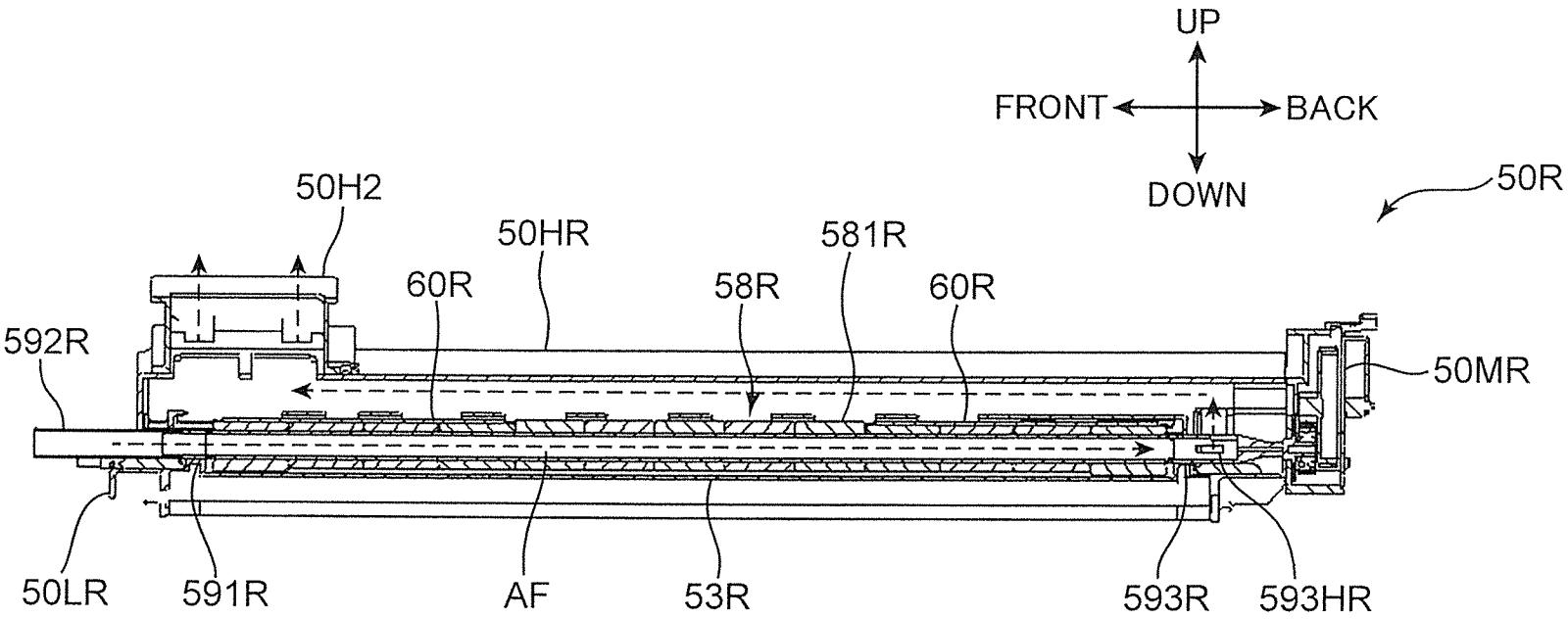
FIG. 17 is a side sectional view of the electromagnetic induction heating unit of the fixing device according to the modification of the present invention.

(1) Although the air flow is introduced from the introducing tube 592 arranged on the front end side of the center core shaft 59, discharged from the drive transmission member 593 arranged on the rear end part and exhausted from the exhaust duct 50H1 formed on the rear side of the shield 50 in the above embodiments, the present invention is not limited to this. FIG. 16 is a perspective view of a coil unit 50R according to a modification of the present invention and FIG. 17 is a sectional view of the coil unit 50R. Note that, in FIGS. 16 and 17, members having structures and functions common to the coil unit 50 of the previous first embodiment are denoted by reference signs obtained by adding R in the ends of the same reference signs as in the first embodiment.

With reference to FIG. 16, the coil unit 50R includes an exhaust duct 50H2 open on a shield 50HR. The exhaust duct 50H2 is open on a front end part of the shield 50HR. Thus, as shown in FIG. 17, an air flow discharged from an exhaust port 593HR after flowing in an internal space AF of a center core shaft 59R is exhausted to the outside of the coil unit 50R from the exhaust duct 50H2 after being guided forward along an inner wall of the shield 50HR. At this time, a peripheral surface of a center core 58R and an unillustrated coil are effectively cooled by the air flow flowing forward from the exhaust port 593HR.

(2) Although the hole portions are arranged axially outwardly of the first center core 581Q in the above third embodiment, the present invention is not limited to this. As in the second embodiment, the hole portions may be formed on the first center core 581P, the second center cores 582P and the magnetic shielding body 60P and the number of the hole portions arranged axially outwardly of the first center core 581P may be set larger than the number of the hole portions arranged on the first center core 581P. Even in this case, parts of the center core 58P and the coil 52P corresponding to the sheet non-passage areas can be effectively cooled when a sheet having the first sheet width passes through the nip portion NP.

(3) Further, although the above first embodiment is described using the fixing belt 48 as the first rotary body, the present invention is not limited to this. The first rotary body to be induction-heated by the coil unit 50 may be a rotary roller body.

(4) Further, although the air flow is ejected from the exhaust ports 593H open on the drive transmission member 593 in the above first embodiment, the present invention is not limited to this. Similar openings may be formed on the front bearing 591 on the front end side of the center core shaft 59 or on the introducing tube 592. In this case, an end adjacent area of the coil 51 located on the front side of the center core shaft 59 can be effectively cooled.

(5) Further, although the air flow flowing into the internal space AF of the center core shaft 59 is generated by the fan 65 in the above first embodiment, the present invention is not limited to this. A fan may be arranged near the exhaust duct 50H1 of the shield 50H as another air flow generator. Further, another air flow generator may be arranged at another position.

(6) Further, although the magnetic shielding body 60 is arranged on the peripheral surface of the center core 58 in the above embodiments, it may be directly arranged on the peripheral surface of the center core shaft 59.

The invention claimed is:

1. A fixing device comprising:

a housing;

a magnetic flux generation source fixed to the housing and configured to generate a magnetic flux;

a first rotary body configured to be rotated in a predetermined direction and induction-heated by the magnetic flux;

a second rotary body configured to be rotated in a predetermined direction, a nip portion through which a sheet carrying a toner image passes being formed between the first and second rotary bodies;

a first core made of a magnetic material and configured to form a magnetic path, along which the magnetic flux passes, together with the first rotary body;

a second core made of a magnetic material, arranged between the first core and the first rotary body when viewed from the magnetic path and rotatable in a predetermined direction;

a shaft portion having a hollow cylindrical shape, configured to hold the second core on a peripheral surface, including an internal space extending along an axial direction inside and serving as a rotary shaft in the rotation of the second core;

a magnetic shielding body made of a nonmagnetic material, arranged on a peripheral surface of the second core or the shaft portion and configured to shield or suppress the magnetic flux by being located in the magnetic path with rotation about the shaft portion; and an air flow generator configured to generate an air flow flowing in the internal space from one end side toward the other end side in the axial direction;

an introducing portion mounted on one end side of the shaft portion in the axial direction and configured to introduce the air flow into the internal space;

a driving portion for generating a rotational drive force for rotating the shaft portion; and a transmitting portion coupled to the driving portion and mounted on the other end side of the shaft portion in the axial direction and configured to transmit the rotational drive force to the shaft portion, the transmitting portion including a communication space communicating with the internal space and an exhaust port communicating with the communication space and open on an outer peripheral surface of the transmitting portion, wherein the magnetic flux generation source being fixed to the housing to surround the second core extending in the axial direction when viewed in a direction perpendicular to the axial direction;

the second core includes:

a center core portion arranged over the entire circumference in a central part of the shaft portion in the axial direction and configured to form the magnetic path in accordance with a first sheet width;

outer core portions arranged to be adjacent at axially outer sides of the center core portion and partially exposed in a circumferential direction and configured to form the magnetic path in accordance with a second sheet width larger than the first sheet width together with the center core portion; and the magnetic shielding body is arranged at least in the same areas as the outer core portions in the axial direction to cover areas of the second core or the shaft portion different from exposed areas in the circumferential direction, and the introducing portion is made of a hollow cylindrical heat resistant material communicating with the internal space and includes a bearing member configured to rotatably support the one end side of the shaft portion and an introducing tube mounted on the bearing member and configured to introduce the air flow toward the internal space via the bearing member.

2. A fixing device according to claim 1, comprising:

a magnetic shield mounted on the housing and configured to cover the magnetic flux generation source and the second core; and an exhaust duct formed on the magnetic shield and configured to exhaust the air flow discharged from the exhaust port.

3. A fixing device according to claim 2, wherein the exhaust duct is arranged on the other end side in the axial direction.

4. A fixing device according to claim 2, wherein the exhaust duct is arranged on the one end side in the axial direction.

5. An image forming apparatus, comprising:

an image carrier configured such that a toner image is formed on a surface;

a transfer unit configured to transfer the toner image onto a sheet; and a fixing device according to claim 1.

6. A fixing device, comprising:

a housing;

a magnetic flux generation source fixed to the housing and configured to generate a magnetic flux;

a first rotary body configured to be rotated in a predetermined direction and induction-heated by the magnetic flux, a second rotary body configured to be rotated in a predetermined direction, a nip portion through which a sheet carrying a toner image passes being formed between the first and second rotary bodies;

a first core made of a magnetic material and configured to form a magnetic path, along which the magnetic flux passes, together with the first rotary body;

a second core made of a magnetic material, arranged between the first core and the first rotary body when viewed from the magnetic path and rotatable in a predetermined direction;

a shaft portion having a hollow cylindrical shape, configured to hold the second core on a peripheral surface, including an internal space extending along an axial direction inside and serving as a rotary shaft in the rotation of the second core;

a magnetic shielding body made of a nonmagnetic material, arranged on a peripheral surface of the second core or the shaft portion and configured to shield or suppress the magnetic flux by being located in the magnetic path with rotation about the shaft portion; and an air flow generator configured to generate an air flow flowing in the internal space from one end side toward the other end side in the axial direction;

a plurality of the hole portions arranged at intervals in a circumferential direction and in the axial direction, the hole portions communicating with the internal space and being open on the peripheral surface of the second core or the magnetic shielding body by penetrating through a wall surface of the shaft portion between one end part and the other end part of the shaft portion, wherein:

the magnetic flux generation source being fixed to the housing to surround the second core extending in the axial direction when viewed in a direction perpendicular to the axial direction;

the second core includes:

a center core portion arranged over the entire circumference in a central part of the shaft portion in the axial direction and configured to form the magnetic path in accordance with a first sheet width;

outer core portions arranged to be adjacent at axially outer sides of the center core portion and partially exposed in a circumferential direction and configured to form the magnetic path in accordance with a second sheet width larger than the first sheet width together with the center core portion; and the magnetic shielding body is arranged at least in the same areas as the outer core portions in the axial direction to cover areas of the second core or the shaft portion different from exposed areas in the circumferential direction.

7. A fixing device according to claim 6, comprising:

an introducing portion mounted on one end side of the shaft portion in the axial direction and configured to introduce the air flow into the internal space;

a driving portion for generating a rotational drive force for rotating the shaft portion; and a transmitting portion coupled to the driving portion and mounted on the other end side of the shaft portion in the axial direction and configured to transmit the rotational drive force to the shaft portion, wherein the transmitting portion includes a communication space communicating with the internal space and an exhaust port communicating with the communication space and open on an outer peripheral surface of the transmitting portion.

8. A fixing device according to claim 7, wherein the exhaust port of the transmitting portion rotates about the shaft portion above an end adjacent area of the magnetic flux generation source adjacent to another axial end part of the second core in the axial direction.

9. A fixing device according to claim 8, wherein the magnetic shielding body is arranged in the magnetic path and the exhaust port is arranged to face the end adjacent area of the magnetic flux generation source by the rotation of the shaft portion when a sheet having the first sheet width passes through the nip portion.

10. A fixing device according to claim 6, wherein the hole portions are arranged in areas axially outwardly of the center core portion.

11. A fixing device according to claim 6, wherein the number of the hole portions arranged axially outwardly of the center core portion is larger than the number of the hole portions arranged on the center core portion.

12. A fixing device according to claim 6, wherein:

the center core portion or the outer core portions is/are formed by adjacently arranging a plurality of cylindrical tube members or arched members mounted on the peripheral surface of the shaft portion in the axial direction; and a part of the hole portion is formed of a cut portion formed on an adjacent end edge of the cylindrical tube member or the arched member.

13. An image forming apparatus, comprising:

an image carrier configured such that a toner image is formed on a surface;

a transfer unit configured to transfer the toner image onto a sheet; and a fixing device according to claim 6.

* * * * *